US007098885B2

(12) United States Patent
Kumada et al.

(10) Patent No.: US 7,098,885 B2
(45) Date of Patent: Aug. 29, 2006

(54) DISPLAY DEVICE, DRIVE CIRCUIT FOR THE SAME, AND DRIVING METHOD FOR THE SAME

(75) Inventors: Kouji Kumada, Tenri (JP); Takashige Ohta, Yamatokoriyama (JP); Haruhito Kagawa, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 212 days.

(21) Appl. No.: 10/357,480

(22) Filed: Feb. 4, 2003

(65) Prior Publication Data

US 2003/0151572 A1 Aug. 14, 2003

(30) Foreign Application Priority Data

Feb. 8, 2002 (JP) ..... P2002-031593
Dec. 19, 2002 (JP) ..... P2002-367738

(51) Int. Cl.
*G09G 3/36* (2006.01)

(52) U.S. Cl. ..... 345/96; 345/87

(58) Field of Classification Search ..... 345/96, 345/98, 100; 709/203
See application file for complete search history.

(56) References Cited

U.S. PATENT DOCUMENTS 4,196,432 A 4/1980 Chihara
6,069,605 A 5/2000 Ozawa
6,166,714 A 12/2000 Kishimoto
6,304,895 B1 * 10/2001 Schneider et al. ..... 709/203
6,642,916 B1 11/2003 Kodama et al.
6,795,047 B1 * 9/2004 Kudo et al. ..... 345/87
2002/0036624 A1 3/2002 Ohta et al.
2002/0050972 A1 * 5/2002 Udo et al. ..... 345/96
2002/0084970 A1 * 7/2002 Oazawa
2003/0058207 A1 3/2003 Washio et al.
2004/0041763 A1 3/2004 Kodama et al.

FOREIGN PATENT DOCUMENTS

JP 53-124098 10/1978
JP 6-337657 A 12/1994
JP 10-62741 A 3/1998
JP 11-030975 2/1999
TW 375696 12/1999

OTHER PUBLICATIONS

Chinese Office Action dated Sep. 2, 2005 (w/English translation).

(Continued)

*Primary Examiner*—Amare Mengistu
*Assistant Examiner*—Tammy Pham
(74) *Attorney, Agent, or Firm*—Nixon & Vanderhye P.C.

(57) ABSTRACT

In a signal line drive circuit of an active-matrix type liquid-crystal display which is a voltage-controlled type display with a capacitive load, n selector switches (161 to 16n) are provided between buffer circuits (151 to 15n) to which voltages responsive to an image to be displayed are inputted from reference voltage selection circuits (131 to 13n), and output terminals (T1 to Tn) to which are connected image signal lines. These selector switches (161 to 16n), based on a shorting control signal (Csh) that is at a high level when the polarity is reversed to perform AC drive of the liquid-crystal panel, switch the output signals (OUT1 to OUTn of the image signal line drive circuit between the output signals of the buffer circuits (151 to 15n) and the common electrode signal (Vcom). By doing this, each of the image signal lines is, for a prescribed time only when the polarity is reversed, separated from the buffer circuits (151 to 15n) and shorted to the common electrode. This configuration reduces the power consumption of the signal line drive circuit

23 Claims, 16 Drawing Sheets

OTHER PUBLICATIONS

CN 1138904A dated Dec. 25, 1996 (U.S. counterpart 6,069,605 listed above).
TW Office Action mailed Apr. 22, 2004 corresponding TW application No. 092101473.
Korean Office Action dated Jan. 26, 2005 (w/out English translation).

* cited by examiner

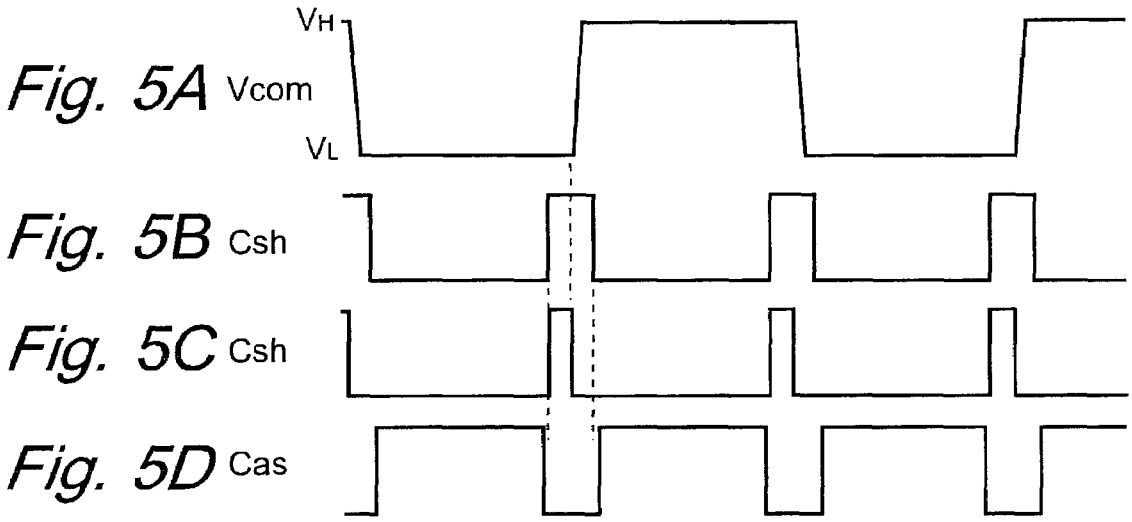
Fig. 5A Vcom
VH
VL
Fig. 5B Csh
Fig. 5C Csh
Fig. 5D Cas

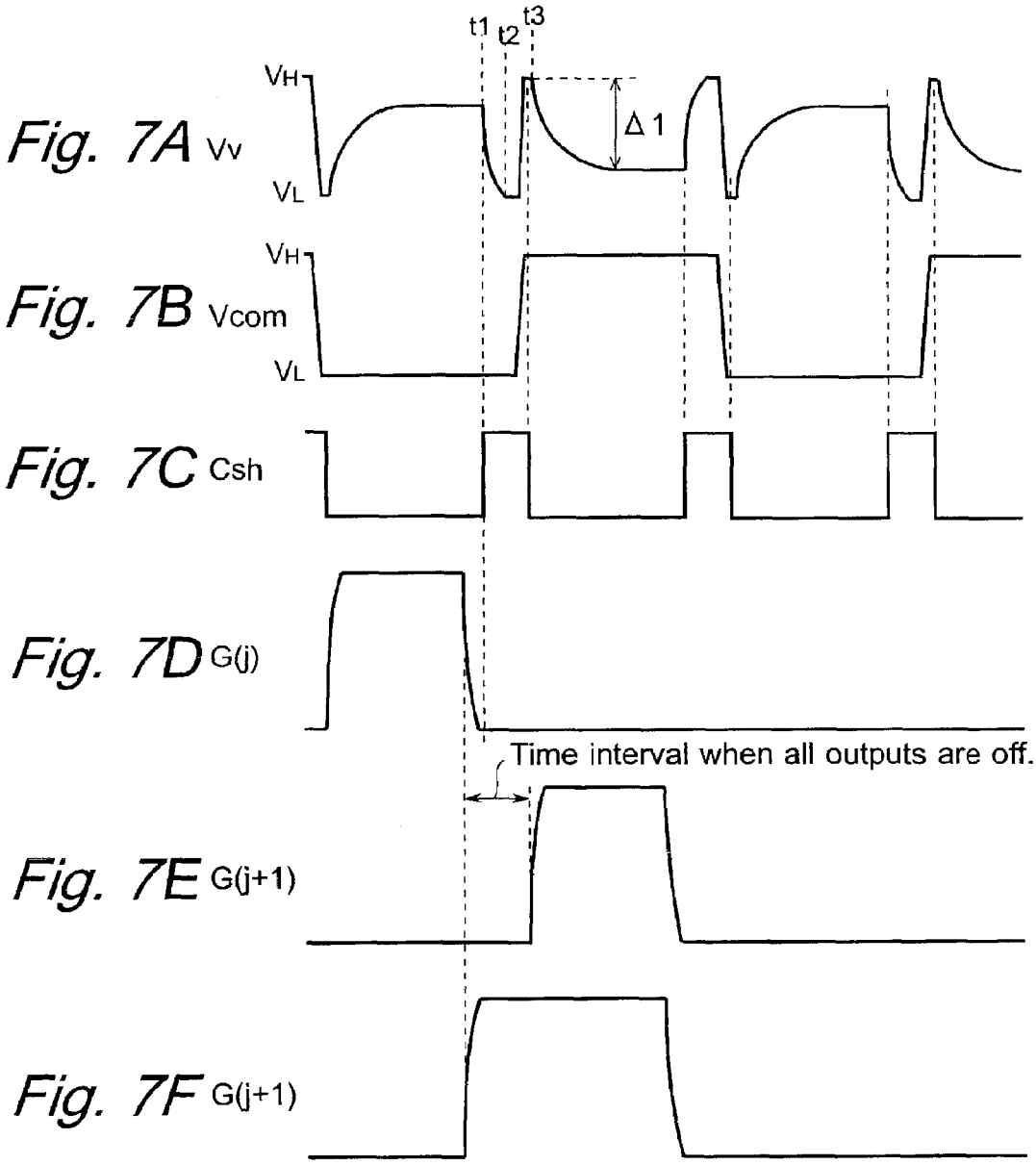
t1
t2
t3
VH
VL
Δ1
Fig. 7A Vv
VH
VL
Fig. 7B Vcom
Fig. 7C Csh
Fig. 7D G(j)
Time interval when all outputs are off.
Fig. 7E G(j+1)
Fig. 7F G(j+1)

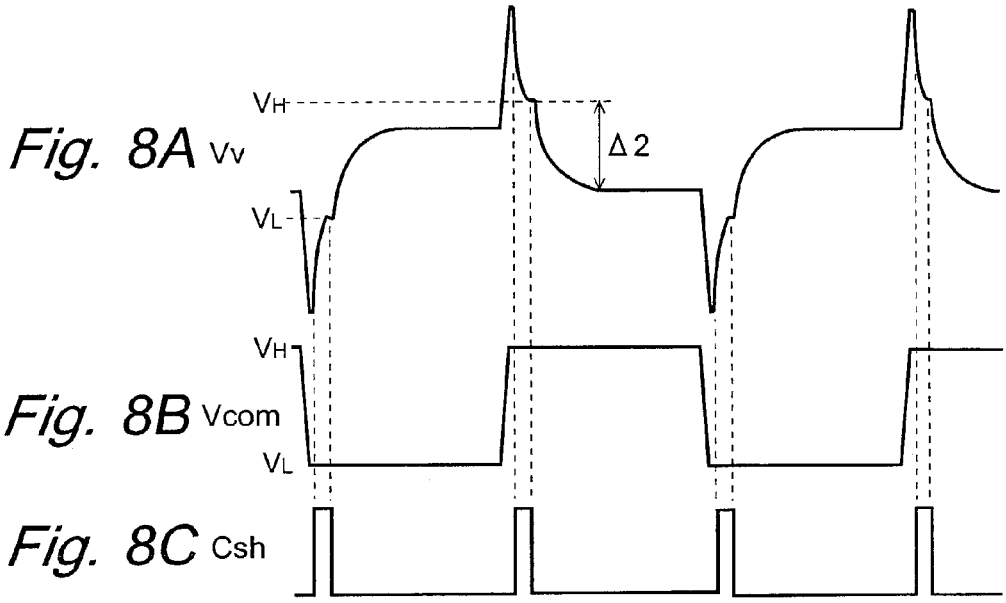
Fig. 8A Vv
VH
VL
Δ2
Fig. 8B Vcom
VH
VL
Fig. 8C Csh

Vv
VH
VL
Δ3

Vcom
VH
VL

Csh

Vv
Δ4

VH
Vcom
VL

Csh

DISPLAY DEVICE, DRIVE CIRCUIT FOR THE SAME, AND DRIVING METHOD FOR THE SAME

BACKGROUND OF THE INVENTION

1. Field of the Invention

The present invention relates to a display device with voltage-controlled active-matrix drive, having a capacitive load, such as in an active-matrix type liquid-crystal display device, and more particularly to a drive circuit for such a display device.

2. Background Art

From the standpoint of extending battery life, there is a serious need to reduce the power consumption in portable information equipment, such as mobile telephones, personal digital assistants (PDAs), and laptop computers. With improvements in processing performance and usable functionality, portable information products, have come to require improved display capabilities, with both high display quality and a larger number of display colors. For this reason, in order to meet the demands for improved display capabilities, active-matrix type liquid-crystal displays (hereinafter referred to as TFT-LCDs) implemented using thin-film transistors (TFTs) are beginning to see use in even such portable information products.

A liquid-crystal panel in a TFT-LCD device (hereinafter referred to as a TFT-LCD panel) has a pair of mutually opposing substrates (a first substrate and a second substrate). These substrates are held fixed with a prescribed distance therebetween (typically several μm) with a liquid-crystal material forming a liquid-crystal layer so as to fill the space between the substrates. At least one of these substrates is transparent, and in the case of making a transmissive-type display, both substrates must be transparent. In a TFT-LCD panel, the first substrate is provided with a plurality of mutually parallel scanning signal lines and a plurality of image signal lines, which are perpendicular to the scanning signal lines. Pixel electrodes are provided at the intersection locations between scanning signal lines and image signal lines, as are pixel TFTs, which serves as switching elements for the purpose of making electrical connection between the pixel electrodes and the corresponding image signal line. The gate terminal of a pixel TFT is connected to a scanning signal line the source terminal of the pixel TFT is connected to an image signal line, and the drain terminal of the pixel TFT is connected to the pixel electrode.

A common electrode, serving as an opposing electrode, is formed over the entire surface of the second substrate, which opposes the first substrate. An appropriate voltage is applied to the common electrode by a common electrode drive circuit, so that a voltage corresponding to potential difference between the pixel electrode and the common electrode is applied across the liquid-crystal layer. Because this applied voltage can be used to control the light transmissivity of the liquid-crystal layer, it is possible to create a desired pixel display by applying an appropriate voltage from the image signal lines.

In order to prevent deterioration of the liquid crystal and to maintain display quality, the above-described TFT-LCD panel is driven by AC drive. Specifically, the TFT-LCD panel is driven so that the polarity of the voltage applied to the liquid crystal is reversed, for example every horizontal scan period. Additionally, in order to reduce the amplitude of the voltage on the image signal line, the potential on the common electrode is changed in response to the above-noted AC drive (by applying what is hereinafter referred to as an AC common electrode signal).

However, even if the use of an AC common electrode signal reduces the amplitude of the voltage on the image signal line, there is still a large variation in potential on the image signal lines when the polarity reverses to achieve AC drive. It is therefore necessary for the image signal line drive circuit to have sufficient capacitive load drive capacity to cause this large a potential change with respect to the capacitive load presented by a TFT-LCD panel. For this reason, the image signal line drive circuit consumes a large amount of power, thereby hindering the achievement of low power consumption in a TFT-LCD display.

SUMMARY OF THE INVENTION

Accordingly, it is an object of the present invention to provide a display device which reduces the power consumption of the AC drive circuit that applies to a capacitive load a voltage responsive to an image to be displayed while reversing the polarity thereof with a prescribed period.

One aspect of the present invention is a display device in which a voltage serving as an image signal representing an image to be displayed is applied to a capacitive load including a capacitance formed by mutually opposing first and second electrodes, and which has a drive circuit that causes the voltage applied to the capacitive load to reverse polarity periodically, this display device having an image signal line drive circuit which supplies a voltage signal responsive to an image to be displayed to the first electrode relative to the second electrode as a reference, and a connection switching circuit which when the polarity of the voltage applied to the capacitive load is reversed, separates the first electrode from the image signal line drive circuit and shorts the first electrode to an electrode providing a voltage level that is equivalent to the voltage supplied to the second electrode.

By adopting the above-noted configuration, when the polarity of the voltage applied to the capacitive load is reversed, the first electrode is electrically separated from the image signal line drive circuit and shorted to an electrode providing a voltage level that is equivalent to the voltage supplied to the second electrode, the charge that had been accumulated in the capacitive load being thereby discharged. By doing this, the amount of change in the potential at the first electrode required after the polarity reversal is reduced. Therefore, even if the drive capacity of the image signal line drive circuit is smaller than in the past, it is possible to reduce the power consumption image signal line drive circuit and also possible to reduce the size of the transistors used to implement the buffer circuit within the image signal line drive circuit. As a result, it is possible to achieve a reduction in both the size and the cost of the display device.

In a display device such as described above, it is preferable that the electrode providing a voltage level that is equivalent to the voltage supplied to the second electrode be the second electrode itself.

By using the second electrode as the electrode providing a voltage level that is equivalent to the voltage supplied to the second electrode, when reversing the polarity of the voltage applied to the capacitive load, the first electrode is electrically separated from the image signal line drive circuit and shorted to the second electrode, so that the charge accumulated in the capacitive load is directly discharged without going through the power supply. By doing this, similar to the general configuration first described above, it is possible to reduce the power consumption of the image signal line drive circuit and also reduce the size of the buffer circuit in the image signal line drive circuit, thereby enabling a reduction in both the size and the cost of the display device.

In a display device configured as described above, it is possible for the drive circuit to apply as the image signal to the capacitive load a voltage representing an image to be displayed based on a horizontal scan and a vertical scan, and cause the polarity of the applied voltage to be reversed at the time of switching of a scan line in the horizontal scan.

By adopting this configuration, in an image display based on horizontal and vertical scanning, that is in the display of an image assembled by repeating a horizontal scan at a prescribed period as the scan starting position is shifted a small amount at a time in the vertical direction, the polarity of the voltage applied to the capacitive load is reversed at the time that the horizontal scan line is switched, and each time the reversal occurs the first electrode is electrically separated from the image signal line drive circuit and shorted to an electrode providing a voltage level that is equivalent to the voltage supplied to the second electrode, the charge that had accumulated in the capacitive load being thereby discharged. By doing this, there is a large effect, for example in reducing the power consumption of the image signal line drive circuit.

This display device can be further configured so as to have a plurality of image signal lines serving as the first electrodes, a plurality of scanning signal lines intersecting with the plurality of image signal lines, a plurality of pixel formation parts each corresponding to one of points of intersection between the plurality of image signal lines and the plurality of scanning signal lines, and disposed in a matrix arrangement, and a scanning signal line drive circuit which selectively drives the plurality of scanning signal lines, wherein each pixel formation part includes a switching element that is switched on and off by a scanning signal line passing through the corresponding intersection point, a pixel electrode connected via the switching element to the image signal line passing through the corresponding intersection point, and a common electrode serving as the second electrode, provided in common to the plurality of pixel formation parts, and disposed so that a prescribed capacitance included in the capacitive load is formed between the common electrode and the pixel electrode, the scanning signal line drive circuit applying to a selected scanning signal line a voltage that turns the switching element on, and the connection switching circuit, when the polarity of the voltage applied to the capacitive load is reversed, electrically separating the image signal lines from the image signal line drive circuit and shorting the image signal lines to an electrode providing a voltage level that is equivalent to the voltage supplied to the common electrode.

According to this configuration, when the polarity is reversed to perform AC drive of the pixel formation parts, each image signal line is electrically separated from the image signal line drive circuit and shorted to an electrode supplying a voltage level that is equivalent to the voltage supplied to the common electrode. By doing this, even if the drive capacity of the image signal line drive circuit is smaller than in the past, because it is possible to apply the same voltage as in the past to the capacitive load formed between the pixel electrode and the common electrode and between the image signal line and the common electrode, it is possible to reduce the power consumption of the image signal line drive circuit, and further possible to reduce the size of the transistors that make up the buffer circuit within the image signal line drive circuit. As a result, it is possible to reduce both the size and the cost of the display device.

In such a display device, it is possible to have the connection switching circuit, after the switching element that had been turned on by the scanning line selected before reversal of the polarity of the voltage applied to the capacitive load is placed in the off state, electrically separate the image signal lines from the image signal line drive circuit and short the image signal lines to an electrode providing a voltage level that is equivalent to the voltage supplied to the common electrode.

By adopting this configuration, after the switching element that had been turned on by the scanning line selected before reversal of the polarity of the voltage applied to the capacitive load is turned off, the image signal lines are electrically separated from the image signal line drive circuit and shorted to an electrode supplying a voltage level that is equivalent to the voltage supplied to the common electrode, the result being that a pixel value to be written into a pixel formation part by an image signal line is not influenced by this shorting operation.

In such a display device, it is possible for the connection switching circuit, when the polarity of the voltage applied to the capacitive load is reversed, to short the image signal lines to an electrode providing a voltage level that is equivalent to the voltage supplied to the common electrode for a period of time that is three or more times the delay time constant which is the product of the wiring resistance and wiring capacitance in one image signal line.

By adopting this configuration, when the polarity of the voltage applied to the capacitive load is reversed, the charge accumulated in the capacitive load (the capacitance formed by each of the image signal lines and the common electrode) is discharged, so that each of the image signal lines and the common electrode are at substantially the same potential. By doing this, the amount of potential change on an image signal line which is to be made by the image signal line drive circuit after polarity reversal is substantially halved compared to the past.

In such a display device, it is further possible to provide the image signal line drive circuit with a stopping control circuit which for at least the period of time during which the connection switching circuit is shorting each of the image signal lines to an electrode providing a voltage level equivalent to the voltage supplied by the common circuit, stops at least part of the image signal line drive circuit.

According to this configuration, it is possible to stop at least part of the image signal line drive circuit without influencing the image display, thereby providing a further reduction in the power consumption of the image signal line drive circuit.

In such a display device, it is possible to adopt a configuration in which the drive circuit includes a common electrode drive circuit which switches the potential on the common electrode in response to the polarity reversal of the voltage applied to the capacitive load, wherein the common electrode drive circuit switches the potential on the common electrode within the period of time during which the connection switching circuit is shorting the image signal lines to an electrode providing a voltage level that is equivalent to the voltage supplied to the common electrode.

By adopting this configuration, because polarity reversal occurs during the shorting period, the period of time used for pixel writing is lengthened.

In this display device, it is possible to adopt a configuration in which the image signal line drive circuit includes reference voltage selection circuits each of which corresponds to one of the plurality of the image signal lines, selects a voltage responsive to the image signal from a plurality of reference voltages, and supplies the selected voltage to the corresponding image signal line as the voltage signal, and in which each of the reference voltage selection circuits includes the connection switching circuit and when the polarity of the voltage applied to the capacitive load is reversed, selects a voltage level equivalent to the common electrode signal which is the voltage supplied to common electrode, instead of a reference voltage from the plurality of reference voltages, and supplies this selected voltage level to a corresponding image signal lines, thereby shorting each of the image signal lines to an electrode supplying a voltage level equivalent to the voltage supplied to the common electrode.

By adopting this configuration, because the connection switching circuit is included in each of the reference voltage selection circuits, the configuration of the image signal line drive circuit in the above-noted display device is simplified, thereby enabling a reduction in the size of the IC chip used to implement the image signal line drive circuit.

In this display device, it is further possible to adopt a configuration in which the image signal line drive circuit includes a plurality of reference voltage bus lines to each of which is given one of the plurality of reference voltages, and a voltage switching circuit which, when the polarity of the voltage applied to the capacitive load is reversed, applies to one reference voltage bus line of the plurality of reference voltage bus lines a voltage level equivalent to the common electrode signal, instead of the reference voltage to be applied to the one reference voltage bus line, wherein each of the reference voltage selection circuits, during each horizontal scan period, selects a reference voltage bus line of the plurality of reference voltage bus lines to which is applied a reference voltage responsive to the image signal and connects the selected bus line to a corresponding image signal line and, when the polarity of the voltage applied to the capacitive load is reversed, selects and connects the one reference voltage bus line to the corresponding image signal line.

By adopting this configuration, although there is an increase of a voltage switching circuit as one switching means, one reference bus line and the switching means within each reference voltage selection circuit corresponding thereto are shared between selection of the reference voltage and selection of the voltage level equivalent to the common electrode signal. By doing this, there is a further reduction in the overall scale of the signal line drive circuitry, thereby making it possible to further reduce the size of the IC chip on which the image signal line drive circuit is implemented.

The above-noted display device can also be configured such that the drive circuit further includes a common electrode drive circuit which switches the potential of the common electrode in response to the reversal of polarity of the voltage applied to the capacitive load, and so that the image signal line drive circuit and the common electrode drive circuit are formed on either one and the same substrate or one and the same chip.

By adopting the above configuration, because the image signal line drive circuit is associated with the common electrode drive circuit via a connection switching circuit, by forming the image signal line drive circuit and the common electrode drive circuit on either one and the same substrate or one and the same chip, it is possible to simplify the configuration of the display device.

Another aspect of the present invention is a drive circuit in a display device of the AC drive type, in which a voltage serving as an image signal to be displayed is applied to a capacitive load including a capacitance formed by a first electrode and a second electrode which are in mutual opposition, and in which the polarity of the voltage applied to the capacitive load is periodically reversed, this drive circuit having an image signal line drive circuit which supplies to the first electrode a voltage signal responsive to the image relative to the second electrode as a reference, and a connection switching circuit which when the polarity of the voltage applied to the capacitive load is reversed, electrically separates the first electrode from the image signal line drive circuit and shorts the first electrode to an electrode providing a voltage level that is equivalent to the voltage supplied to the second electrode itself.

In the above-noted drive circuit, it is preferable that the electrode providing a voltage level equivalent to the voltage supplied to the second electrode be the second electrode.

Yet another aspect of the present invention is a method for driving using a driving circuit in a display device of the AC drive type, in which a voltage serving as an image signal representing an image to be displayed is applied to a capacitive load including a capacitance formed by a first electrode and a second electrode which are in mutual opposition, and in which the polarity of the voltage applied to the capacitive load is periodically reversed, this method including a step of supplying a voltage signal responsive to the image to the first electrode relative to the second electrode as a reference, and a step of, when the polarity of the voltage applied to the capacitive load is reversed, electrically separating the first electrode from the part of the drive circuit that supplies the voltage signal to the first electrode, and shorting the first electrode to an electrode providing a voltage level that is equivalent to the voltage supplied to the second electrode.

In the above-noted drive method, it is preferable that the electrode providing a voltage level equivalent to the voltage supplied to the second electrode be the second electrode itself.

These and other objects, features, aspects, and advantages of the present invention will be more apparent from the following detailed description of the present invention when taken in conjunction with the accompanying drawings.

BRIEF DESCRIPTION OF THE DRAWINGS

FIG. 5A to FIG. 5D are signal waveform diagrams illustrating stopping control of the image signal line drive circuit in the first embodiment.

FIG. 7A to FIG. 7F are voltage and signal waveform diagrams illustrating a first liquid-crystal panel drive method in the first embodiment.

FIG. 8A to FIG. 8C are voltage and signal waveform diagrams illustrating a second liquid-crystal panel drive method in the first embodiment.

DETAILED DESCRIPTION OF THE PREFERRED EMBODIMENTS

Embodiments of the present invention are described below in detail, with references made to relevant accompanying drawings.

1. First Embodiment (1.1 Overall Configuration and Operation)

Figure 1:
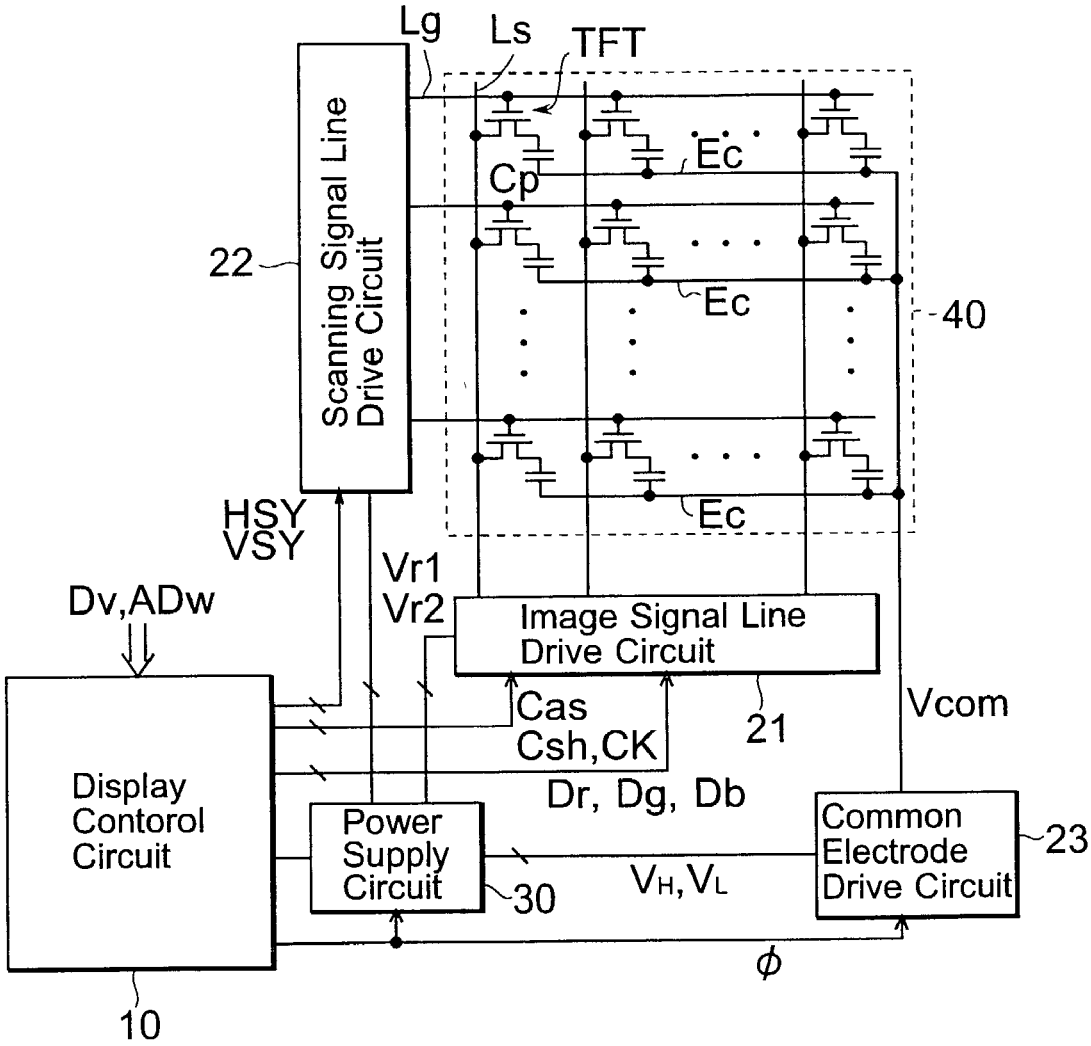
FIG. 1 is a block diagram showing the configuration of a liquid-crystal display according to a first embodiment of the present invention.

FIG. 1 is a block diagram showing the configuration of a liquid-crystal display according to a first embodiment of the present invention, which has a display control circuit 10, an image signal line drive circuit 21, a scanning signal line drive circuit 22, a common electrode drive circuit 23, a power supply circuit 30, and an active-matrix type liquid-crystal panel 40, wherein AC drive is used in order to reduce deterioration or the like of the liquid crystal, in which the polarity of a voltage applied to the liquid crystal is reversed every one horizontal scanning interval.

The liquid-crystal panel 40 serving as a display part in this liquid-crystal display includes a plurality of scanning signal lines Lg each corresponding to a horizontal scanning line in the image of image data Dv, which is received from an external CPU or the like, a plurality of image signal lines Ls, which intersect with each of the plurality of scanning signal lines Lg, and a plurality of pixel formation parts, provided so as to correspond to points of intersection between the plurality of scanning signal lines Lg and the plurality of image signal lines Ls. The plurality of pixel formation parts are disposed in a matrix arrangement, each of the pixel formation parts having the same type of configuration as the configuration in an active-matrix type liquid-crystal panel in the past, and having a TFT as a switching element, the source terminal of which is connected to an image signal line Ls passing through a corresponding intersection point, a pixel electrode connected to the drain terminal of the TFT, a common electrode Ec, which is an opposing electrode provided in common associated with the plurality of pixel formation parts, and a liquid-crystal layer, provided in common for the plurality of pixel formation parts, which is sandwiched between the pixel electrodes and the common electrode Ec.

In the above-noted configuration, a pixel capacitance Cp is formed by a pixel electrode, the common electrode Ec, and the liquid crystal sandwiched therebetween. This liquid-crystal display is described in detail below, and it will be noted that there are examples of this type of liquid-crystal display in which, for example, a common electrode Ec is formed on an opposing electrode different from the TFT substrate forming the pixel electrodes, and a type in which the common electrode Ec is formed not on the opposing electrode, but rather on the TFT substrate. In the example described below, the liquid-crystal panel 40 has n image signal lines Ls, and the liquid-crystal panel 40 has 64 gradations.

In this embodiment, image data (in the narrow sense of the term) representing pixels to be displayed on the liquid-crystal panel (including not only images, but also characters and graphics and the like) and display control data, which is data that determines timing and the like of the display operation (for example, data indicating the frequency of the display clock) is sent from an external CPU or the like to a display control circuit 10 (this data sent from outside hereinafter being referred to as image data in the broad sense of the term, and denoted by the reference symbol Dv). Specifically, an external CPU or the like supplies the (narrow-sense) image data and display control data making up the (broad-sense) image as well as an address signal ADw to the display control circuit 10, and thereby writes the (narrow-sense) image data and display control data respectively into a display memory and a register within the display control circuit 10, which are described below.

The display control circuit 10, based on display control data written in the register, generates a clock signal CK, a horizontal synchronization signal HSY, and a vertical synchronization signal VSY, and also generates, based on the horizontal synchronization signal HSY, a polarity reversal control signal $\phi$ for the purpose of performing AC drive, a shorting control signal Csh, and amplifier stopping control signal Cas. The display control circuit 10 reads image data that is written in the display memory by the external CPU or the like, and outputs three types of digital image signals, Dr, Dg, and Db. Of these, the digital signal Dr is the image signal representing the red component of the image to be displayed (hereinafter referred to as the red image signal), the digital signal Dg is the image signal representing the green component of the image to be displayed (hereinafter referred to as the green image signal), and the digital signal Db is the image signal representing the blue component of the image to be displayed (hereinafter referred to as the blue image signal). In this manner, of the signals generated by the display control circuit 10, the clock signal CK is supplied to the image signal line drive circuit 21, the horizontal synchronization signal HSY and the vertical synchronization signal VSY are supplied to the scanning signal line drive circuit 22, the digital image signals Dr, Dg, and Dc, amplifier stopping control signal Cas, and shorting control signal Csh are supplied to the image signal line drive circuit 21, and the polarity reversal control signal ϕ is supplied to the common electrode drive circuit 23 and to the power supply circuit 30. As described above, because the number of gradations is taken to be 64 in this embodiment, each of the digital image signals Dr, Dg, and Db has 6 bits, so that 6×3=18 lines are required to supply the digital image signals Dr. Dg, and Db from the display control circuit 10 to the image signal line drive circuit 21.

The power supply circuit 30 supplies a power supply voltage for operation to the display control circuit 10, the image signal line drive circuit 21, the scanning signal line drive circuit 22, and the common electrode drive circuit 23, and also supplies to the image signal line drive circuit 21, the scanning signal line drive circuit 22, and the common electrode drive circuit 23 a reference voltage, which is a voltage serving as a reference for generating a signal to be applied to the liquid-crystal panel 40. The values of reference voltages Vr1 and Vr2 supplied to the image signal line drive circuit 21 are alternatively switched between two pre-established values in response to the polarity reversal control signal ϕ, so that when the polarity reversal control signal ϕ is at a high level the values are such that Vr1<Vr2, and so that when the polarity reversal control signal ϕ is at a low level the values are such that Vr1>Vr2. The common electrode drive circuit 23 is supplied with two voltages, VH and VL, serving as reference voltages, such that VH>VL.

Data representing an image to be displayed by the liquid-crystal panel 40 are supplied as the digital image signals Dr, Dg, and Db in pixel-serial form, as well as a signal indicating timing, the clock signal CK as a control signal, the amplifier stopping control signal Cas, the shorting control signal Csh, and the reference voltages Vr1 and Vr2 are supplied to the image signal line drive circuit 21. The image signal line drive circuit 21, based on these signals and the reference voltages, generates for each image signal line an image signal (hereinafter referred to as an image drive signal) for driving the liquid-crystal panel 40, and applies each of the image drive signals to one of the image signal lines Ls in the liquid-crystal panel 40.

The scanning signal line drive circuit 22, based on the horizontal synchronization signal HSY and the vertical synchronization signal VSY, generates scanning signals each to be applied to one of the scanning signal lines Lg of the liquid-crystal panel 40 for each horizontal scanning period, so as to select the scanning signal lines Lg alternately and sequentially, repeating the application of an active scanning signal (voltage which turns the TFT on) to each of the scanning signal lines Lg for sequential selection of all the scanning signal lines Lg, with one vertical scanning interval as the period.

The common electrode drive circuit 23 generates a common electrode signal Vcom for application of a prescribed potential to the common electrode Ec of the liquid-crystal panel 40. In this embodiment, to reduce the amplitude of the voltage of the image signal line Ls, the potential of the common electrode Ec is also changed in response to the AC drive. That is, the common electrode drive circuit 23, in response to the polarity reversal control signal ϕ from the display control circuit 10, generates a voltage signal that is alternately switched between the two reference voltages VH and VL for each one horizontal scanning interval, so that when the polarity reversal control signal ϕ is at a high level the voltage is VH and when the polarity reversal control signal ϕ is at a low level the voltage is VL, this voltage being supplied as the common electrode signal Vcom to the common electrode Ec of the liquid-crystal panel 40. By doing this, the positive and negative polarity of the voltage at the image signal line Ls relative to the reference potential at the common electrode Ec can be reversed for each horizontal scanning interval, while reducing the voltage on the image signal line Ls.

In a liquid-crystal panel 40 such as described above, image drive signals based on digital image signals Dr, Dg, and Db from the image signal line drive circuit 21 are supplied to the image signal lines Ls, a scanning signal is supplied from the scanning signal line drive circuit 22 to the scanning signal line Lg, and a common electrode signal Vcom is supplied from the common electrode drive circuit 23. By doing this, voltages corresponding to the potential difference between the pixel electrodes and the common electrode Ec, and responsive to the digital image signals Dr, Dg, and Db, are applied to the liquid-crystal panel 40, the polarity of the applied voltages being reversed every one horizontal scanning interval. By making the applied voltages control the transmissivity of the liquid-crystal layer, the liquid-crystal panel 40 displays a color image of the image data received from an external CPU or the like.

(1.2 Display Control Circuit)

Figure 2:
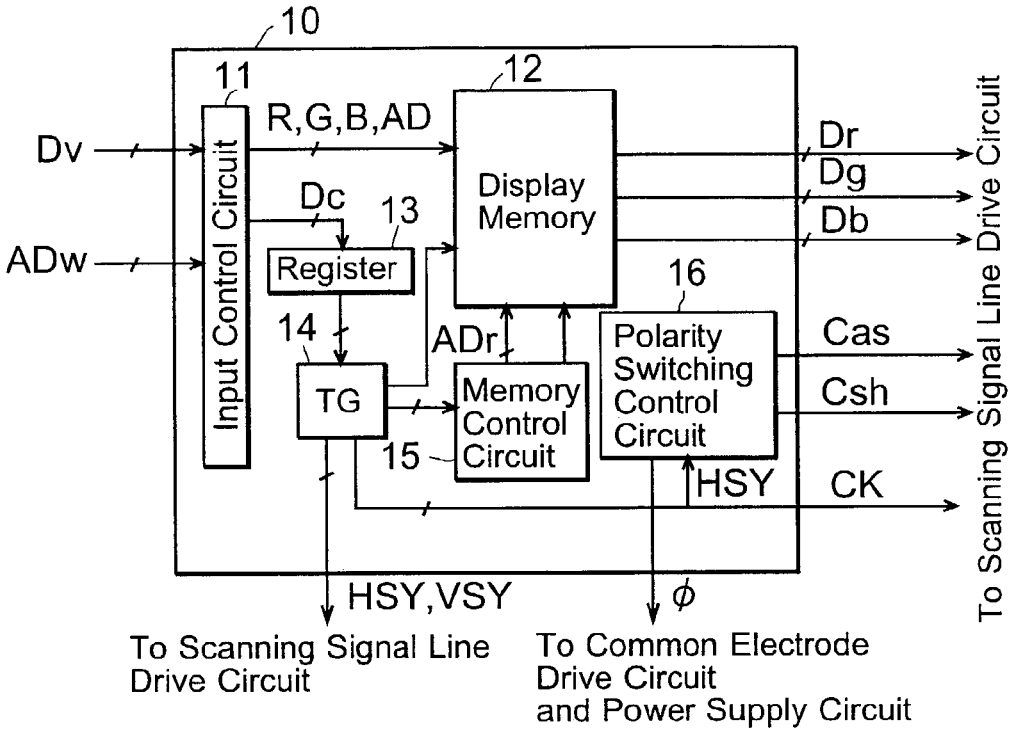
FIG. 2 is a block diagram showing the configuration of a display control circuit in the first embodiment.

FIG. 2 is a block diagram showing the configuration of the display control circuit 10 in the above-described liquid-crystal display. This display control circuit 10 has an input control circuit 11, a display memory 12, a register 13, a timing generator circuit 14, a memory control circuit 15, and a polarity switching control circuit 16.

The display control circuit 10 inputs a signal representing the image data Dv (which will also hereinafter be denoted by the reference symbol Dv) in the broad-sense of image data received from an external CPU or the like and the address signal ADw to the input control circuit 11. The input control circuit 11, based on the address signal ADw, divides the broad-sense image data Dv into the three color image data R, G, and B, and the display control data Dc. By supplying the signals representing the color image data R, G, and B (which will also hereinafter be denoted by the reference symbols R, G, and B) along with an address signal AD based on the address signal ADw to the display memory 12, the three image data R, G, and B are written into the display memory 12 and the display control data Dc is written into the register 13. The three image data R, G, and B are, respectively, data which represent the red component, the green component, and the blue component of the image represented by the image data Dv. The display control data Dc includes the frequency of the clock CK, and the timing information specifying the horizontal scanning interval and the vertical scanning interval for display of the image represented by image data Dv.

The timing generator circuit 14, based on the display control data held in the register 13, generates the clock signal CK, the horizontal synchronization signal HSY, and the vertical synchronization signal VSY. The timing generator circuit 14 also generates a timing signal for the purpose of synchronizing the operation of the display memory 12 and the memory control circuit 15 to the clock signal CK.

The memory control circuit 15 generates an address signal ADr for reading out data from the image data R, G, and B stored in the display memory 12 that represents the image to be displayed on the liquid-crystal panel 40, and a signal for the purpose of controlling the operation of the display memory 12. The address signal ADr and the control signal are given to the display memory 12, resulting in data representing the red component, the green component, and the blue component of an image to be displayed on the liquid-crystal panel 40 being read out and outputted to the display control circuit 10 from the display memory 12 as the red image signal Dr, the green image signal Dg, and the blue image signal Db, respectively. These three digital image signals Dr, Dg, and Db are supplied to the image signal line drive circuit 21, which is described later.

The polarity switching control circuit 16 generates the amplifier stopping control signal Cas and the shorting control signal Csh, based on the horizontal synchronization signal HSY generated by the timing generator circuit 14. The amplifier stopping control signal Cas is a control signal for the purpose of stopping each of the buffer circuits, to be described later, in the image signal line drive circuit 21, for a prescribed period of time, when the polarity of the voltage on the image signal line Ls referenced relative to the common electrode Ec potential is reversed, and the shorting control signal Csh is a control signal for the purpose of shorting each of the image signal lines Ls and the common electrode Ec at the time of polarity reversal, for just a prescribed amount of time. The amplifier stopping control signal Cas and the shorting control signal Csh are supplied to the image signal line drive circuit 21 as described later.

(1.3 Image Signal Line Drive Circuit)

Figure 3:
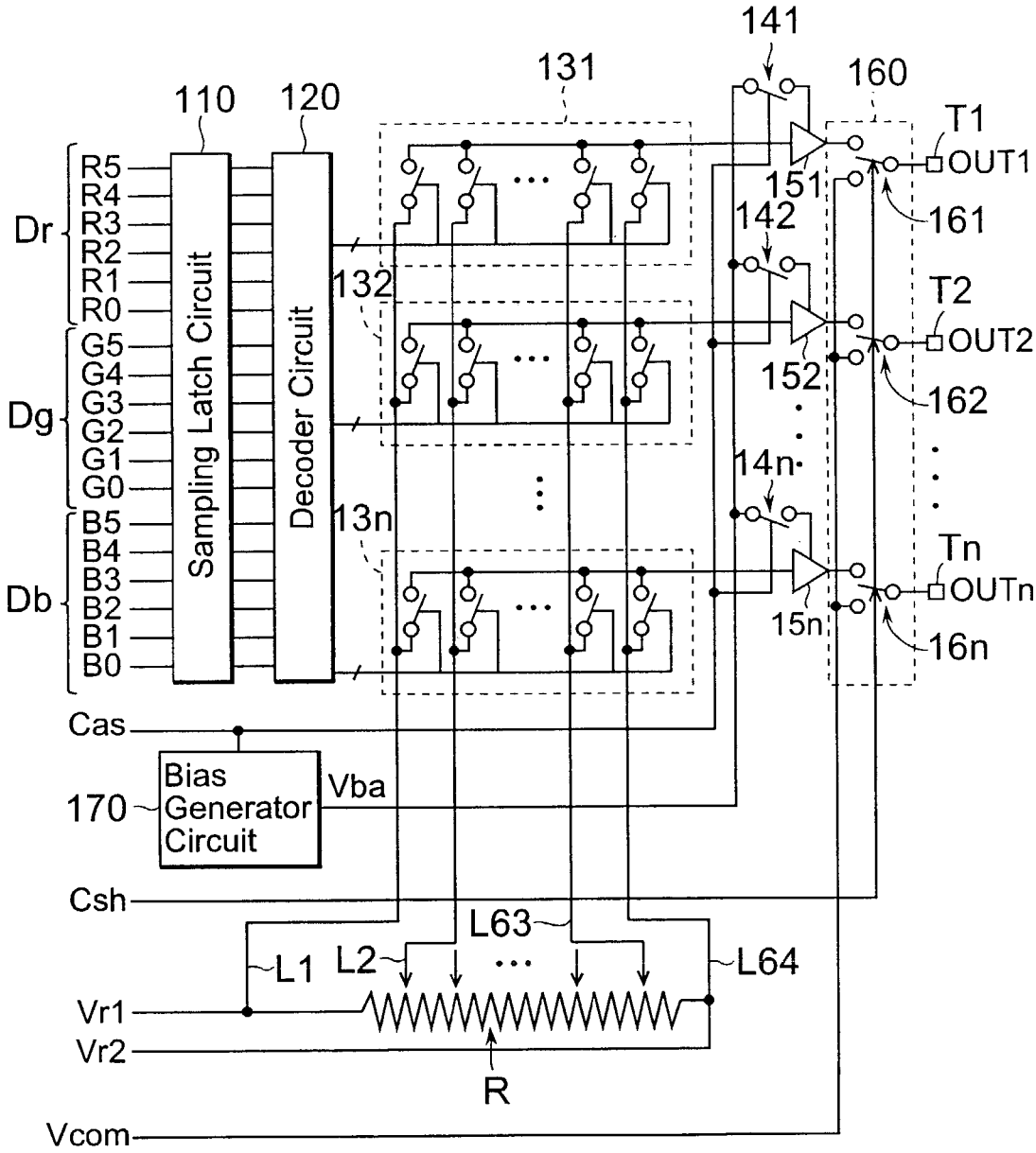
FIG. 3 is a circuit diagram showing the configuration of an image signal line drive circuit in the first embodiment.

FIG. 3 is a circuit diagram showing the configuration of the image signal line drive circuit 21 in the above-described liquid-crystal display. The image signal line drive circuit 21 is a circuit that generates image drive signals to be supplied to respective image signal lines Ls in the liquid-crystal display 40, the image signal line drive circuit 21 supplying n image drive signals to n image signal lines Ls in the liquid-crystal display 40. The image signal line drive circuit 21 has a sampling latch circuit 110, a decoder circuit 120, n reference voltage selection circuits 131 to 13*n*, n buffer circuits 151 to 15*n*, n stopping control circuit 141 to 14*n*, which are on/off switches, a connection switching circuit 160, which is formed by n selector switches 161 to 16*n*, a bias generator circuit 170, which generates an amplifier bias Vba to be supplied to the buffer circuits 151 to 15*n*, a voltage divider resistance R, 64 reference voltage bus lines L1 to L64 for supplying 64 types of reference voltage to the reference voltage selection circuits 131 to 13*n*, this number of reference voltage selection circuits corresponding to the number of gradations in the image display, and n output terminals T1 to Tn, to which n image signal lines Ls are respectively connected.

In the above-described image signal line drive circuit 21, the sampling latch circuit 110 receives from the display control circuit 10 the red image signal Dr, formed by 6-bit image signals R5 to R0, the green image signal Dg, formed by 6-bit image signals G5 to G0, and the blue image signal Db, formed by 6-bit image signals B5 to B0, and samples and latches these image signals R5 to R0, G5 to G0, and B5 to B0, outputting these image signals after latching as internal image signals. These internal image signals are inputted to the decoder circuit 120.

The decoder circuit 120, based on the internal image signals from the sampling latch circuit 110, generates n groups of decoded outputs, each corresponding to one of the n image signal lines Ls, the n groups of decoded outputs being input respectively to the n reference voltage selection circuits 131 to 13*n*. Each of the n groups of decoded output is made up of 64 signals, one signal of each of these groups of 64 signals being made active in response to the above-noted internal image signals, with the other signals being inactive.

The voltage divider resistance R has one end which is connected to a first reference voltage Vr1, and another end which is connected to a second reference voltage Vr2, so as to form a voltage divider circuit, this voltage divider circuit generating, in addition to the first and second reference voltages Vr1 and Vr2, 62 other types of reference voltages. The 62 reference voltages generated in this manner and the first and second reference voltages Vr1 and Vr2 are applied, respectively, to the 64 reference voltage bus lines L1 to L64, and are, by means of the reference voltage bus lines L1 to L64, supplied to each of the reference voltage selection circuits 131 to 13*n*. The 64 types of reference voltages are used to apply a voltage to between the pixel electrodes and the common electrode Ec, this voltage being responsive to each of the gradations of the image display.

The n reference voltage selection circuits 131 to 13*n* correspond, respectively, to the n image signal lines Ls, and include 64 switches, this number being equal to the number of gradations. The 64 switches in each of the reference voltage selection circuits 131 to 13*n* input as control signals the 64 signals that make up the decoded output inputted to reference voltage selection circuit to which the switches belong. Each of the switches is on if the signal inputted thereto is active and off if the signal inputted thereto is inactive. By using this type of switch, each of the reference voltage selection circuits 131 to 13*n*, in response to the decoded outputs inputted thereto, selects one of the 64 types of reference voltages supplied thereto by the 64 reference voltage bus lines, and outputs the selected reference voltage (hereinafter referred to as the selected reference voltage). In this manner, n selected reference voltages outputted from the n reference voltage selection circuits are inputted respectively to the n buffer circuits 151 to 15*n*.

During the time when the amplifier bias Vba is being supplied, each of the buffer circuits 151 to 15*n* functions as a voltage follower, meaning that it has an extremely high input impedance and also has a extremely low output impedance, with a gain of substantially 1, but when the amplifier bias Vba supply is stopped, each of the buffer circuits goes into the stopped condition, in which the power consumption thereof is small enough to neglect, and in which the output impedance is extremely high.

The buffer circuits 151 to 15*n* are provided with stopping control circuits 141 to 141*n*, respectively, the stopping control circuits 141 to 14*n* acting to control the supply of the amplifier bias Vba to the respective buffer circuits 151 to 15*n*. That is, amplifier stopping control signal Cas such as shown in FIG. 5D is supplied from the display control circuit 10 to the image signal line drive circuit 21, and when the amplifier stopping control signal Cas is at the high level the stopping control circuits 141 to 14*n* allow the supply of the amplifier bias Vba to the respective buffer circuits 151 to 15*n*, but when the amplifier stopping control signal Cas is at the low level, block the supply of the amplifier bias Vba to the respective buffer circuits 151 to 15*n*. The time interval in which the shorting control signal Csh is at the high level (corresponding to the time interval during which each image signal line Ls is shorted to the common electrode Ec) is either the same as the time interval during which the amplifier stopping control signal Cas is at the low level (this hereinafter being referred to as the amplifier stopped interval, refer to FIG. 5B) or a prescribed time interval that includes the amplifier stopped interval (refer to FIG. 5C). When each of the image signal lines Ls is shorted to the common electrode Ec, therefore, the outputs of the buffer circuits 151 to 15*n* are always in the high-impedance state.

The output signals from the n buffer circuits 151 to 15*n* are inputted to n selector switches 161 to 16*n*, respectively, which make up the connection switching circuit 160. Each of the selector switches 161 to 16*n* has a first terminal, a second terminal, and a third terminal, the above-noted output signals that are inputted to the selector switches 161 to 16*n* being applied to the respective first terminals thereof. The common electrode signal Vcom from the common electrode drive circuit 23 is inputted to the selector switches 161 to 16*n*, and is applied to the second terminal of each of the selector switches. The third terminals of the selector switches 161 to 16*n* are connected to the output terminals T1 to Tn, respectively, of the image signal line drive circuit 21, these n output terminals T1 to Tn being connected to the n image signal lines Ls of the liquid-crystal panel 40. Each of the selector switches 161 to 16*n* makes the third terminal connected to the first terminal when the shorting control signal Csh is at the low level, and makes the third terminal connected to the second terminal when the shorting control signal Csh is at the high level. By doing this, when the shorting control signal Csh is at the low level, the output signals from the buffer circuits 151 to 15*n* are supplied to the respective image signal lines Ls, and when the shorting control signal Csh is at the high level, the common electrode signal Vcom is supplied to the image signal lines Ls. When the shorting control signal Csh is at the high level, therefore, there is a shorting between the signal line which leads to the common electrode signal Vcom and each of the image signal lines Ls, meaning that there is a short between the common electrode Ec and each of the image signal lines Ls.

(1.4 Common Electrode Drive Circuit)

Figure 4A:
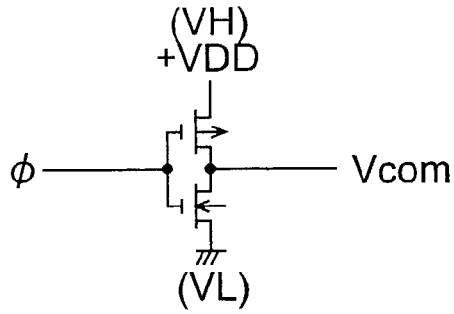
FIG. 4A is a circuit diagram showing a first example of the configuration of a common electrode drive circuit in the first embodiment
Figure 4B:
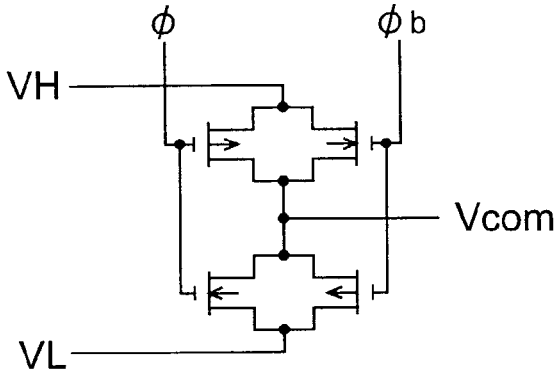
FIG. 4B is a circuit diagram showing a second example of the configuration of a common electrode drive circuit in the second embodiment.
Figure 4C:
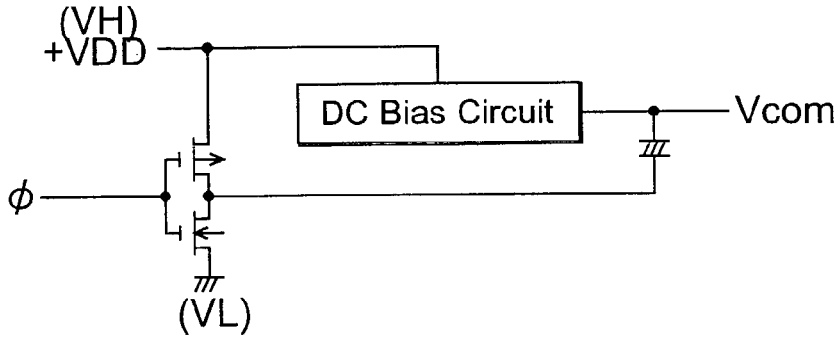
FIG. 4C is a circuit diagram showing a third example of the configuration of a common electrode drive circuit in the first embodiment.

FIG. 4A to FIG. 4C are circuit diagrams showing examples of the configuration of the common electrode drive circuit 23 in the liquid-crystal display configured as described above. Because the common electrode drive circuit must in general have a large driving capacity, rather than using an analog buffer, the power consumption of which itself is large, it is common to use a switching circuit type of common electrode drive circuit. Given this, the configurations shown in each of FIG. 4A to FIG. 4C are not analog buffer type drive circuits, but rather switching circuit type drive circuits using MOS transistors as switching elements.

In the first configuration example, shown in FIG. 4A, the common electrode drive circuit is formed by a p-channel MOS transistor (hereinafter abbreviated as pMOS transistor) and an n-channel MOS transistor (hereinafter abbreviated as nMOS transistor), the drain terminals of both these MOS transistors being mutually connected, the source terminal of the pMOS transistor being connected to the power supply line VDD, which provides the reference voltage VH, and the source of the nMOS transistor being connected to the ground line, which provides the reference voltage VL. The polarity reversal control signal ϕ is inputted to the gates of both MOS transistors, and the voltage at the mutually connected drain terminals of the MOS transistors is outputted as the common electrode signal Vcom. Therefore, the common electrode signal Vcom is VL (ground level) when the polarity reversal control signal ϕ is at the high level, and is VH (a prescribed positive power supply voltage) when the polarity reversal control signal ϕ is at the low level.

In the second configuration example, as shown in FIG. 4B, the common electrode drive circuit is implemented by two analog switches each formed by a pMOS transistor and an nMOS transistor mutually connected in parallel, the reference voltage VH being provided at one end of the first analog switch, and the reference voltage VL being provided at one end of the second analog switch, and the other ends of both analog switches being mutually connected. The polarity reversal control signal ϕ is inputted to the gate terminals of the pMOS transistor of the first analog switch and the nMOS transistor of the second analog switch, and signal ϕb, which is the polarity reversal control signal ϕ inverted, is inputted at the gate terminals of the nMOS transistor of the first analog switch and the pMOS transistor of the second analog switch. The voltage at the point of connection between the mutually connected analog switches is outputted as the common electrode signal Vcom. Therefore, the common electrode signal Vcom is VL when the polarity reversal control signal ϕ is at the high level, and is VH when the polarity reversal control signal ϕ is at the low level.

In the third configuration example, as shown in FIG. 4C, the common electrode drive circuit, in addition to the circuit of the first configuration example, includes a DC bias circuit and a DC blocking capacitor, the drain terminals of the pMOS transistor and the nMOS transistor being connected to the output terminal of the DC bias circuit via the DC blocking capacitor, and the voltage at the point of connection thereof being output as the common electrode signal Vcom. By doing this, the common electrode signal Vcom is maintained at an amplitude of (VH−VL), the same as in the first configuration example, and the DC bias circuit functions to adjust that level.

(1.5 Liquid-Crystal Panel Drive Method)

A method for driving a liquid-crystal display configured as described above is described below.

Figure 6A:
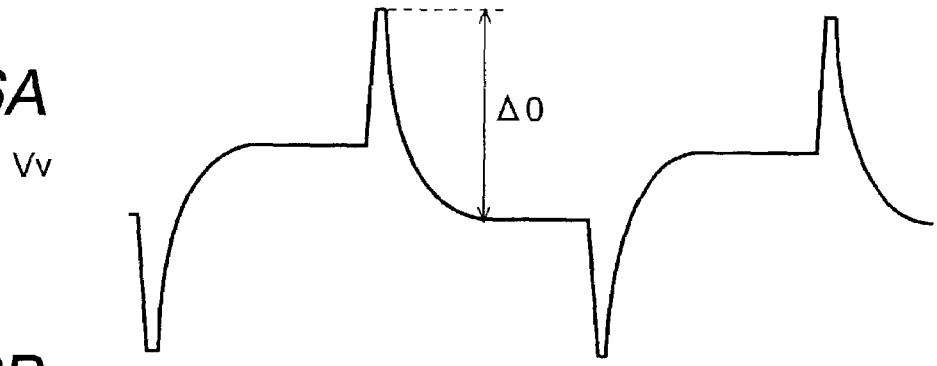
FIG. 6A and FIG. 6B are voltage and signal waveform diagrams illustrating the liquid-crystal panel drive method in a conventional liquid-crystal display.
Figure 6B:
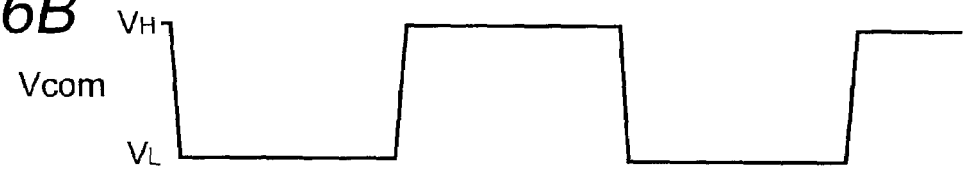

In a liquid-crystal display of the past, in addition to performing AC drive, whenever the polarity of the voltage applied across the liquid-crystal layer of the liquid-crystal panel being reversed every one horizontal scanning interval, the drive method also includes use of an AC common electrode signal so as to reduce the amplitude of the voltage on the image signal lines, the image signal line potential Vv in the liquid-crystal panel varies as shown in FIG. 6A, and the common electrode signal Vcom, which is the potential of the common electrode Ec, varies as shown in FIG. 6B. In this case, however, the image signal line potential Vv is taken as being the potential at a position that is sufficiently distant from the point of connection between the image signal line drive circuit and the image signal line (this applying below as well). As shown in FIG. 6A, in a liquid-crystal display of the past, the image signal line drive circuit, in the case of the normally white mode, must be able to cause a change in the image signal line that is at maximum twice the voltage to be applied across the liquid-crystal layer in order to display black.

In contrast to the above, in the case of this embodiment, based on the horizontal synchronization signal HSY a shorting control signal Csh as shown in FIG. 7C is generated, and when the polarity of the voltage of the image signal line Ls referenced to the potential of the common electrode Ec is reversed, each of the image signal lines Ls in the liquid-crystal panel, in accordance with the shorting control signal Csh, is electrically separated from the image signal line drive circuit 21 and also shorted to the common electrode Ec. That is, in the reversal of polarity that occurs every one horizontal synchronization interval, the scanning signal G(j) applied to the scanning signal line Lg that was immediately previously selected becomes inactive (low level), and after all of the TFTs connected to this scanning signal line Lg are turned off, for example at some time t1 (refer to FIG. 7A), the shorting control signal Csh changes to the high level, and each of the image signal lines Ls in the liquid-crystal panel 40, by the connection switching circuit 160, is electrically separated from the image signal line drive circuit 21 and shorted to a signal line that leads to the common electrode signal Vcom. During the period of time in which each image signal line Ls and the common electrode Ec are shorted (this being referred to as the shorting interval, which can be treated as the same as the time period during which the shorting control signal Csh is at the high level), the charge accumulated in the capacitance formed between the image signal lines and the common electrode Ec is discharged, so that for example at some time t2 the image signal lines Ls and the common electrode Ec are at substantially the same potential. As shown in FIG. 7B and 7C, during the shorting interval the positive/negative polarity of the voltage on the image signal line Ls referenced to the potential of the common electrode Ec reverses based on the polarity reversal control signal ϕ (this positive/negative polarity reversal being referred to hereinafter as "polarity reversal"). Therefore, the value of the common electrode signal Vcom switches between the two reference voltages VL and VH during the shorting interval. By the switching of the value of the common electrode signal Vcom, the potential Vv of the image signal line Ls also changes by the amount of the change in the common electrode signal Vcom. Thereafter, when the shorting control signal Csh changes from the high level to the low level, the buffer circuits 151 to 15*n* within the image signal line drive circuit 21 are connected to the respective image signal lines Ls. After the elapse of the polarity reversal interval, for example at some time t3, the supply of the inverted-polarity image drive signals to the image signal lines Ls is started, and when the TFTs connected to the scanning signal line Lg selected next (refer to FIG. 7E), the image drive signals are applied to the pixel electrodes connected to these TFTs.

According to a method such as described above, the waveform (voltage waveform) of the potential Vv on the image signal line Ls in the liquid-crystal panel 40 is as shown in FIG. 7A. The part of the voltage waveform during the period in which the shorting control signal Csh is at the low level, is the waveform in accordance with the output signals of the output buffer circuits 151 to 15*n* within the image signal line drive circuit 21. In this embodiment, as can be seen by comparing FIG. 7A with FIG. 6A, without substantially changing the voltage applied across the liquid-crystal layer, it is possible to achieve a significant reduction in the voltage amplitude on the image signal lines Ls to be changed in comparison with the past. That is, by the operation of shorting the image signal lines Ls and the common electrode Ec by means of the connection switching circuit 160 (hereinafter simply referred to as the shorting operation), the image signal lines Ls and the common electrode Ec are at substantially the same potential, so that the amount of change Δ1 of the potential Vv of the image signal lines Ls in accordance with the buffer circuits 151 to 15*n* within the image signal line drive circuit 21 is substantially one-half of the amount of change Δ0 of the potential Vv of the image signal lines Ls in accordance with the buffer circuits within the image signal line drive circuit of the past (FIG. 6A).

In the above, it was assumed that within the shorting interval each image signal line Ls and the common electrode Ec become at substantially the same potential, and in order for this assumption to hold it is necessary to set the shorting interval (pulse width of the shorting control signal Csh) in accordance with the value of the capacitance formed in the liquid-crystal panel 40 between the image signal line Ls and the common electrode Ec and the resistance value of the image signal line Ls. In a lumped-constant circuit formed by a resistance and a capacitance (integrator circuit) in which the charge accumulated in the capacitor is caused to discharge, when an amount of time that is three times the time constant, which is the product of the resistance value and the capacitance value, elapses, the approximately 95% of the charge that had been accumulated originally in the capacitor is discharged. In this embodiment, the shorting interval is set so that it is a period of time that is at least three times the delay time constant that is the product of the wiring resistance value and the wiring capacitance value of one image signal line Ls. In reality, because it is necessary to consider the on-state resistance of the switch in the connection switching circuit 160 and the impedance of the common electrode drive circuit 23 and the like in establishing the shorting interval, the length of the shorting interval is preferably made at least three times the above-noted delay time constant.

The amount of time that can be used for writing a pixel value into a pixel formation part in the liquid-crystal panel 40 (that is, for charging the pixel capacitance Cp by a voltage corresponding to a pixel value) is the time of the horizontal scanning interval after subtracting the shorting interval and the polarity reversal interval. According to the above-described method, therefore, because the polarity reversal is performed within the shorting interval, if one horizontal scanning interval is held fixed, there is the advantage that the time usable for writing the pixel value is made long.

As shown in FIG. 5B to FIG. 5D, in at least the shorting interval, the amplifier stopping control signal Cas is at the low level, and all the buffer circuits 151 to 15*n* and the bias generator circuit 170 are in the stopped condition.

In the above-described drive method, the scanning line G(j+1) selected immediately after the above-noted switching interval is at the high level (active), as shown in FIG. 7C to FIG. 7E, after the shorting control signal Csh changes to the low level. Therefore, when all the TFTs in the liquid-crystal panel 40 are off, each of the image signal lines Ls are shorted to the common electrode Ec. However, during the time period in which the shorting control signal Csh is at the high level (shorting interval), even if the scanning signal G(j+1) becomes active and the TFTs connected to scanning lines Lg leading to the scanning signal G(j+1) switch on, and pixel electrodes connected to these TFTs are shorted to the common electrode Ec, because the charging time constant of the pixel capacitance is between several tens of times and several hundred times the charging time constant of the image signal line Ls, during the short shorting operation, there is substantially no change in the potential on these pixel electrodes. Even if the potential on these pixel electrodes should change, the potential change is in the direction that approaches a potential corresponding to the pixel value to be written next. Therefore, as shown in FIG. 7F, the scanning signal G(j+1) of the scanning signal line Lg selected immediately after the above-noted polarity reversal can change to the high level before the shorting control signal Csh changes to the high level.

Although in the above-described drive method the polarity reversal is performed during the shorting interval, it is alternatively possible to perform the polarity reversal outside of the shorting interval. For example, in a case in which the polarity reversal is performed before the shorting interval, the waveforms of the potential Vv on the image signal line Ls, the common electrode signal Vcom, and the shorting control signal Csh are as shown in FIG. 8A to FIG. 8C. in this case as well, the amount of change Δ2 of the potential Vv on the image signal line Ls according to the buffer circuits 151 to 15*n* within the image signal line drive circuit 21 is, by virtue of the shorting operation, substantially one-half of the amount of potential change Δ0 (FIG. 6A) of the image signal line Ls in the past, this representing a significant reduction.

Figures 9A, 9B, 9C:
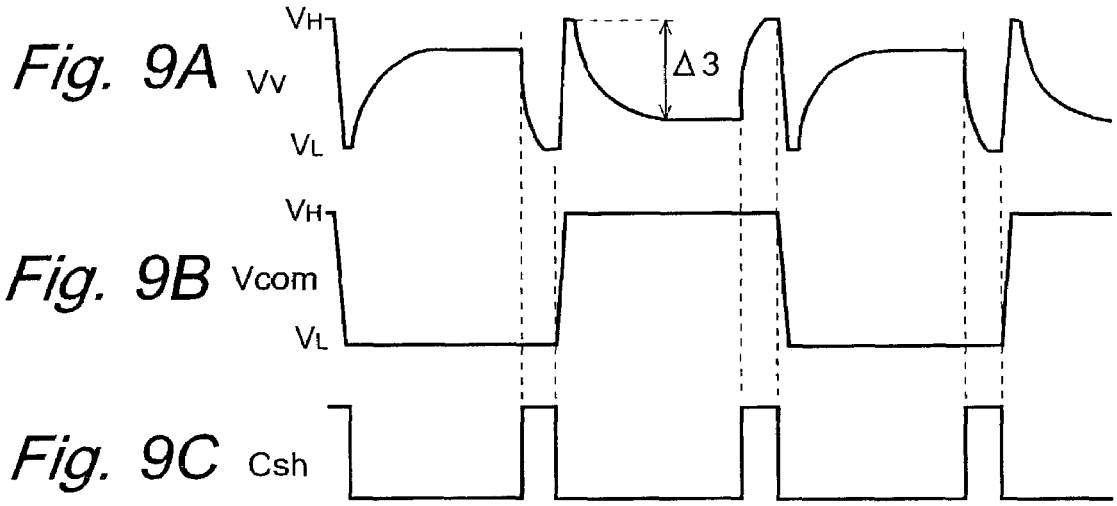
FIG. 9A to FIG. 9C are voltage and signal waveform diagrams illustrating a third liquid-crystal panel drive method in the first embodiment.

Additionally, in a case in which the polarity reversal is performed after the shorting interval, the waveforms of the potential Vv on the image signal line Ls, the common electrode signal Vcom, and the shorting control signal Csh are as shown in FIG. 9A to FIG. 9C. In this case as well, the amount of change Δ3 of the potential Vv on the image signal line Ls according to the buffer circuits 151 to 15*n* within the image signal line drive circuit 21 is, by virtue of the shorting operation, substantially one-half of the amount of potential change Δ0 (FIG. 6A) of the image signal line Ls in the past, this representing a significant reduction.

Figures 10A, 10B, 10C:
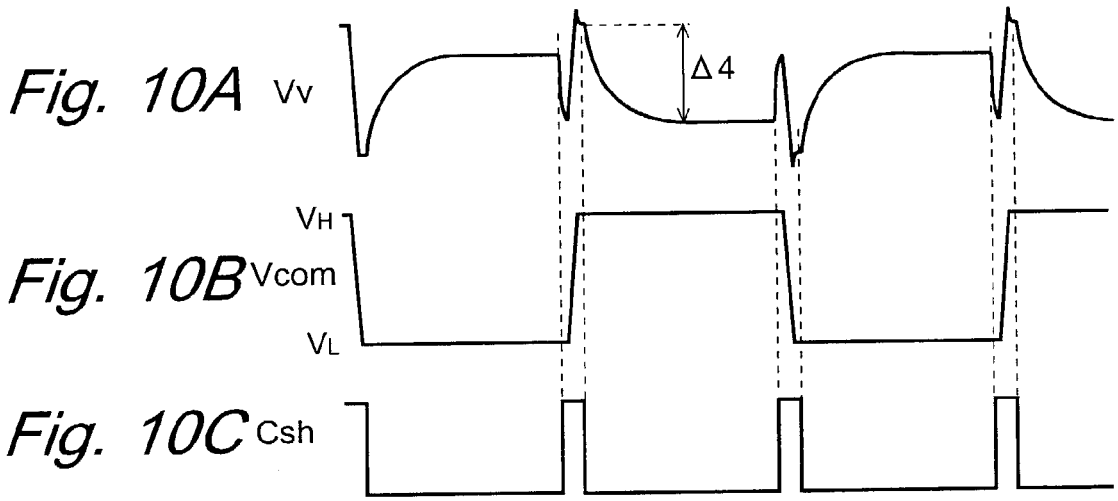
FIG. 10A to FIG. 10C are voltage and signal waveform diagrams illustrating a fourth liquid-crystal panel drive method in the first embodiment.

Additionally, in a case in which the drive of the image signal lines Ls by the buffer circuits 151 to 15*n* is started before the completion of the discharging by the shorting operation, because the shorting interval is short although the polarity reversal is performed within the shorting interval, the waveforms of the potential Vv on the image signal line Ls, the common electrode signal Vcom, and the shorting control signal Csh are as shown in FIG. 10A to FIG. 10C. In this case, the amount of change Δ4 of the potential Vv on the image signal line Ls according to the buffer circuits 151 to 15*n* within the image signal line drive circuit 21 is larger than one-half of the amount of potential change Δ0 (FIG. 6A) of the image signal line Ls in the past, and is however significantly smaller than the amount of potential change Δ0 in the past by virtue of the shorting operation.

As described above, even if the timing of causing the shorting of the image signal line Ls and the common electrode Ec (shorting interval) does not completely coincide with the reversal of the polarity of the voltage applied to the image signal line referenced to the common electrode Ec (the polarity reversal interval), which is the time of the polarity reversal of the voltage applied to the capacitive load, it is sufficient that it be possible to treat this as being synchronized relative to one horizontal scanning interval, and if it is within this range of synchronization, there is no particular problem with regard to relative before/after timing before/after between the shorting and polarity reversal intervals. It will be understood that, although in the above-noted embodiment it is indicated that the image signal line Ls and the common electrode Ec are shorted, that is that the common electrode signal Vcom is supplied to the image signal line Ls, at the time of the polarity reversal, the present invention is not restricted to the common electrode signal Vcom, it being alternatively possible to supply to the image signal line Ls a voltage level that is equivalent to the common electrode signal Vcom. For example, it is possible to provide a circuit similar to the common electrode drive circuit 23, and to supply to the image signal line Ls a voltage level equivalent to that of the common electrode signal Vcom. It will be understood that, in an embodiment such as described above, if a common electrode signal Vcom itself is used as the voltage level equivalent to that of the common electrode signal Vcom, it is not necessary to provide a circuit for generating a voltage level equivalent to the common electrode signal Vcom other than the common electrode drive circuit 23. This will apply in the description to follow, which is based on the assumption that at the time of polarity reversal the image signal line Ls or the like is shorted with the common electrode Ec, that is, that the image signal line Ls or the like is supplied with the common electrode signal Vcom, although it will be understood that there is no restriction to the common electrode signal Vcom, it being possible also to supply to the image signal line Ls or the like a voltage level equivalent to the common electrode signal Vcom. That is, the electrode that is to be shorted with the image signal line Ls or the like at the time of polarity reversal is not restricted to being the common electrode Ec, but can alternatively be an electrode that supplies a voltage level equivalent to that of the common electrode signal Vcom.

(1.6 Advantageous Effect)

In the above-described embodiment, polarity reversal is performed every one horizontal synchronization interval in order to implement AC drive of the liquid-crystal panel 40, and when the polarity reversal occurs each image signal line Ls is electrically separated from the buffer circuits 151 to 15*n* within the image signal line drive circuit 21 and shorted to the common electrode Ec. By doing this, the charge accumulated in the capacitance formed by image signal lines Ls and the common electrode Ec is discharged, after which the image signal lines Ls are reconnected to the buffer circuits 151 to 15*n* within the image signal line drive circuit 21. Therefore, the amount of change Δ1, Δ2, Δ3, or Δ4 (amount of change when the shorting control signal Csh is at the low level) of the potential Vv on the image signal line Ls in accordance with the buffer circuits 151 to 15*n* is significantly smaller than the amount of potential change Δ0 of the image signal line Ls in the past, so that in the case in which the image signal lines Ls and the common electrode Ec become at the same potential within the shorting interval, there is substantially a halving of the amount of change Δ0 of the past. That is, whereas the amount of change (voltage change) to be made in the image signal line in the next horizontal synchronization interval in the case of the normal white mode was two times the maximum voltage required for a black display, in the above-described embodiment it is no more than the amount of voltage required for a black display. As a result, in this embodiment even if the buffer circuits used have a smaller drive capacity than the buffer circuits used in the past, it is possible to apply across the liquid-crystal layer in the liquid-crystal panel a voltage equivalent to the voltage applied in the past. For this reason, by using buffer circuits having a lower drive capacity than those used in the past, it is possible to reduce the power consumption of the image signal line drive circuit 21 and reduce the size of the transistors used in the buffer circuits used in the buffer circuits 151 to 15*n*, thereby enabling a reduction in the cost of the IC chip used to implement the image signal line drive circuit 21. By doing this, it is possible to achieve a compact, low-cost liquid-crystal display. A liquid-crystal display according to this embodiment of the present invention, therefore, is suitable for used in portable equipment.

Because the wiring capacitance in each of the image signal lines Ls in the liquid-crystal panel 40 is sufficiently larger than the capacitance Cp for one pixel connected to each of the image signal lines Ls, the above-described method for enabling use of buffer circuits having a low drive capacity using a shorting operation is effective regardless of whether the scanning signal line Lg is active or inactive at the time of the shorting operation. The fact that the amount of potential change at the image signal line Ls in the next horizontal synchronization interval after the above-noted polarity reversal is small means more generally that the current to be supplied from the power supply to the image signal line Ls (current consumption) is made small. That is, by the shorting operation at the time of polarity reversal, because the charge accumulated in the capacitance formed between the image signal line Ls and the common electrode Ec is directly discharged, without going through the power supply, there is reduction in the current supplied to the image signal line from the power supply (capacitance between the image signal line and the common electrode) commensurate with this direct discharging, resulting in a reduction in the power consumption of the image signal line drive circuit 21. As described above, it is alternatively possible, rather than to cause shorting of the image signal line Ls to the common electrode Ec at the time of polarity reversal, to cause shorting thereof to a different electrode supplying a voltage that is equivalent to that of the common electrode signal Vcom, in which case, the current for the purpose of causing a discharging of the charge accumulated in the capacitance between the image signal line and the common electrode Ec is sometimes supplied from a power supply via a prescribed circuit. However, the voltage level that is equivalent to that of the common electrode signal Vcom can be supplied to the image signal line Ls not from buffer circuits 151 to 15*n* functioning as analog buffers, but rather from a circuit formed by MOS transistors or the like as switching elements, in the same manner as the common electrode drive circuit 23. In this case as well, therefore, compared to the conventional configuration, it is possible to achieve a great reduction in the power consumption.

In the above-described embodiment, because the buffer circuits 151 to 15*n* and the bias generator circuit 170 are stopped by the amplifier stopping control signal Cas during the shorting interval or a prescribed period of time that includes the shorting interval, this also contributes to a reduction in the power consumption of the image signal line drive circuit 21.

In the Japanese unexamined patent application publication H6-337657, there is disclosure of a liquid-crystal display characterized in that during a vertical blanking interval the output potential on an image signal line is made to be the same as the potential on the common electrode of a liquid-crystal pixel. This liquid-crystal display, in so far as it reduces the power consumption by making the potential on the image signal line and the potential on the common electrode the same, is similar to the above-described embodiment. However, whereas in this liquid-crystal display the charging and discharging of the liquid crystal pixel is reduced by eliminating the difference in potential between the image signal line and the common electrode during the vertical blanking interval, which is unrelated to the display, thereby reducing wasteful power consumption, in the above-described embodiment of the present invention, the drive capacity that is required of the buffer circuits 151 to 15*n* is made small by shorting (equalizing the potential between) the image signal lines Ls and the common electrode Ec at the time of polarity reversal for AC drive of the liquid-crystal panel 40, thereby reducing the power consumption of the image signal line drive circuit 21, the basic ideas for solving the problem of reducing the power consumption being different between the two. Furthermore, in a case such as described above, in which the polarity of the voltage applied to the liquid-crystal panel (liquid-crystal layer) is reversed every one horizontal synchronization interval by AC drive, the two different not only in terms of constitution, but also in the degree of reduction of the power consumption, and it is not possible with the liquid-crystal display noted in the Japanese unexamined patent application publication H6-337657 to achieve a great effect in reducing the power consumption.

Furthermore, because the common electrode drive circuit 23 in the above-described embodiment is implemented using MOS transistors as switching elements, there is a large drive capacity in spite of a small power consumption, and the shorting of each image signal line Ls and the common electrode Ec for each one horizontal synchronization interval such as done in the above-described embodiment does not impose a load on the common electrode drive circuit 23. Also, in an active-matrix type liquid-crystal display such as described regarding the above embodiment, because the voltage level supplied to the image signal line Ls immediately after the image signal line Ls is made inactive (that is, the associated TFTs are at the voltage level that turns them off) does not influence the display on the liquid-crystal panel 40, the above-noted shorting operation does not create a display problem.

2. Second Embodiment

Figure 11:
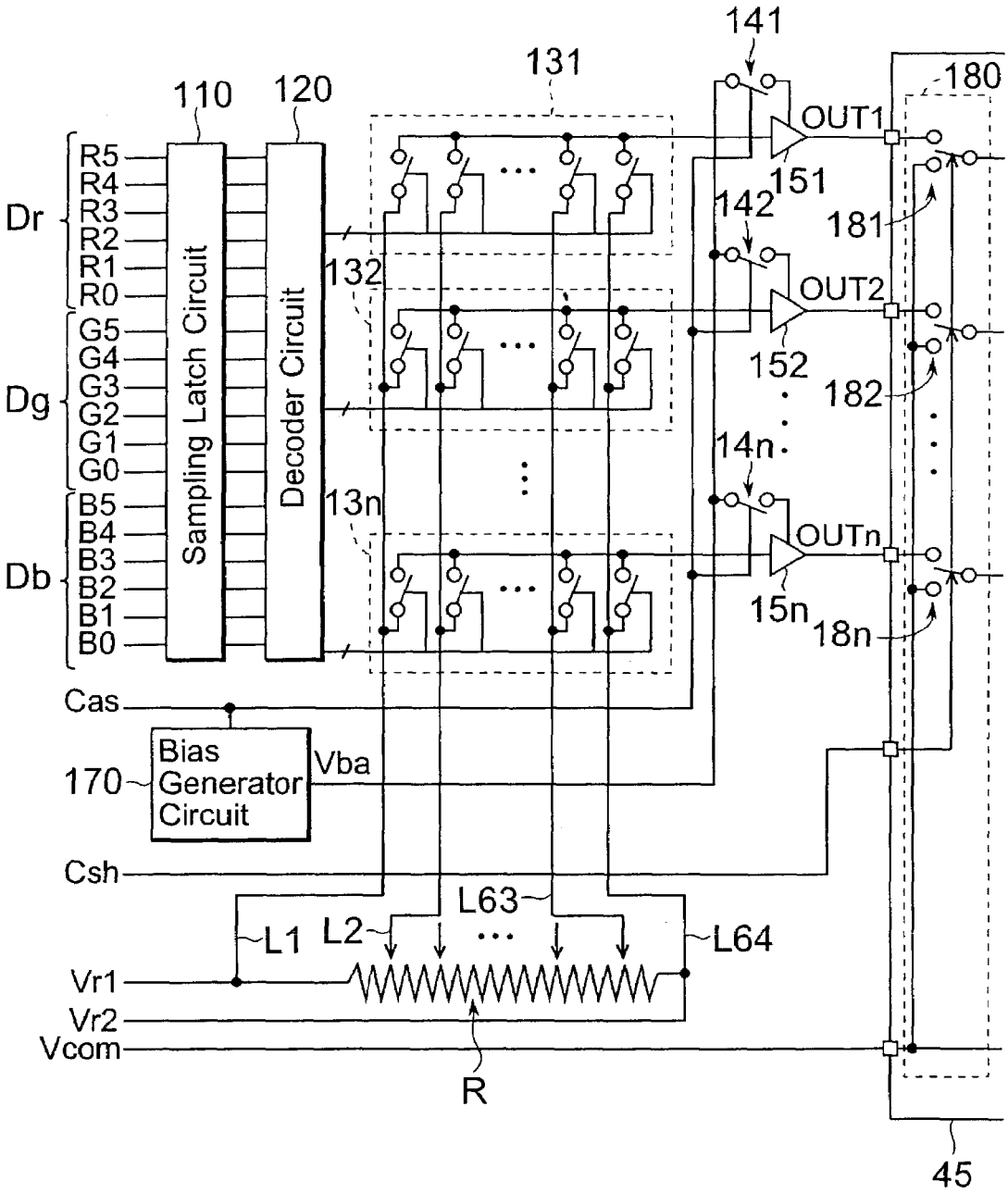
FIG. 11 is a circuit diagram showing the configuration of an image signal line drive circuit in a second embodiment of the present invention.

FIG. 11 is a circuit diagram showing the configuration of an image signal line drive circuit in a liquid-crystal display according to a second embodiment of the present invention, and also showing the configuration of the part supplying signals to image signal lines Ls in the liquid-crystal panel 45. In the liquid-crystal display according to this embodiment, differing from that of the first embodiment, a connection switching circuit 180 that causing shorting of the image signal lines to the common electrode Ec is built into the liquid-crystal panel 45, and the image signal line drive circuit does not include a connection switching circuit 160. That is, the outputs of the buffer circuits 151 to 15*n* are outputted as OUT1 to OUTn from the image signal line drive circuit, and inputted to the connection switching circuit 180 within the liquid-crystal panel 45. The shorting control signal Csh and the common electrode signal Vcom are also inputted to the connection switching circuit 180. This connection switching circuit 180, similar to the connection switching circuit 160 in the first embodiment, is formed by n selector switches 181 to 18*n*, the n output signals OUT1 to OUTn from the image signal line drive circuit being inputted respectively to the selector switches 181 to 18*n*. Each of the selector switches 181 to 18*n* has a first, a second, and a third terminal, the output signals OUT1 to OUTn inputted to the selector switches 181 to 181*n* being applied to the first terminals thereof. The common electrode signal Vcom from the common electrode drive circuit 23 is applied to the second terminals of the selector switches 181 to 18*n*. The image signal lines Ls in the liquid-crystal panel 45 are connected to the third terminals of the respective selector switches 181 to 18*n*. The selector switches 181 to 18*n* make connection to the first terminal when the shorting control signal Csh is at the low level, and make connection to the shorting control signal Csh is the high level. By doing this, when the shorting control signal Csh at the low level, the output signals from the buffer circuits 151 to 15*n* are supplied to the respective image signal lines Ls, and when the shorting control signal Csh is at the high level, the common electrode signal Vcom is supplied to the image signal lines Ls. Therefore, when the shorting control signal Csh is at the high level, there is a shorting between each of the image signal lines Ls and the common electrode Ec. Aspects of this embodiment of the present invention other than noted above are the same as described with regard to the first embodiment, and corresponding elements in the second embodiment are assigned the same reference numerals as in the first embodiment and are not explicitly described herein. With regard to the method of driving the liquid-crystal panel as well, description is not provided, as this is the same as described regarding the first embodiment.

In the embodiment described above as well, similar to the case of the first embodiment, when the polarity of the voltages applied to the image signal lines Ls in the liquid-crystal panel 45 is reversed for AC drive thereof, the image signal lines Ls are electrically separated from the buffer circuits 151 to 15*n* within the image signal line drive circuit and shorted to the common electrode Ec. By doing this, even if buffer circuits having a drive capacity that is smaller than in the past are used as the buffer circuits 151 to 15*n* in the image signal line drive circuit, it is possible to apply a voltage to the liquid-crystal panel that is similar to that applied in the past. Therefore, according to this embodiment, by using a buffer circuit having a drive capacity that is lower than in the past, it is possible to reduce the power consumption of the image signal line drive circuit, and further possible to reduce the size of the transistors used to implement the buffer circuits 151 to 15*n*. As a result, it is possible to achieve a reduction in both the size and the cost of the liquid-crystal display.

3. Third Embodiment

Figure 12:
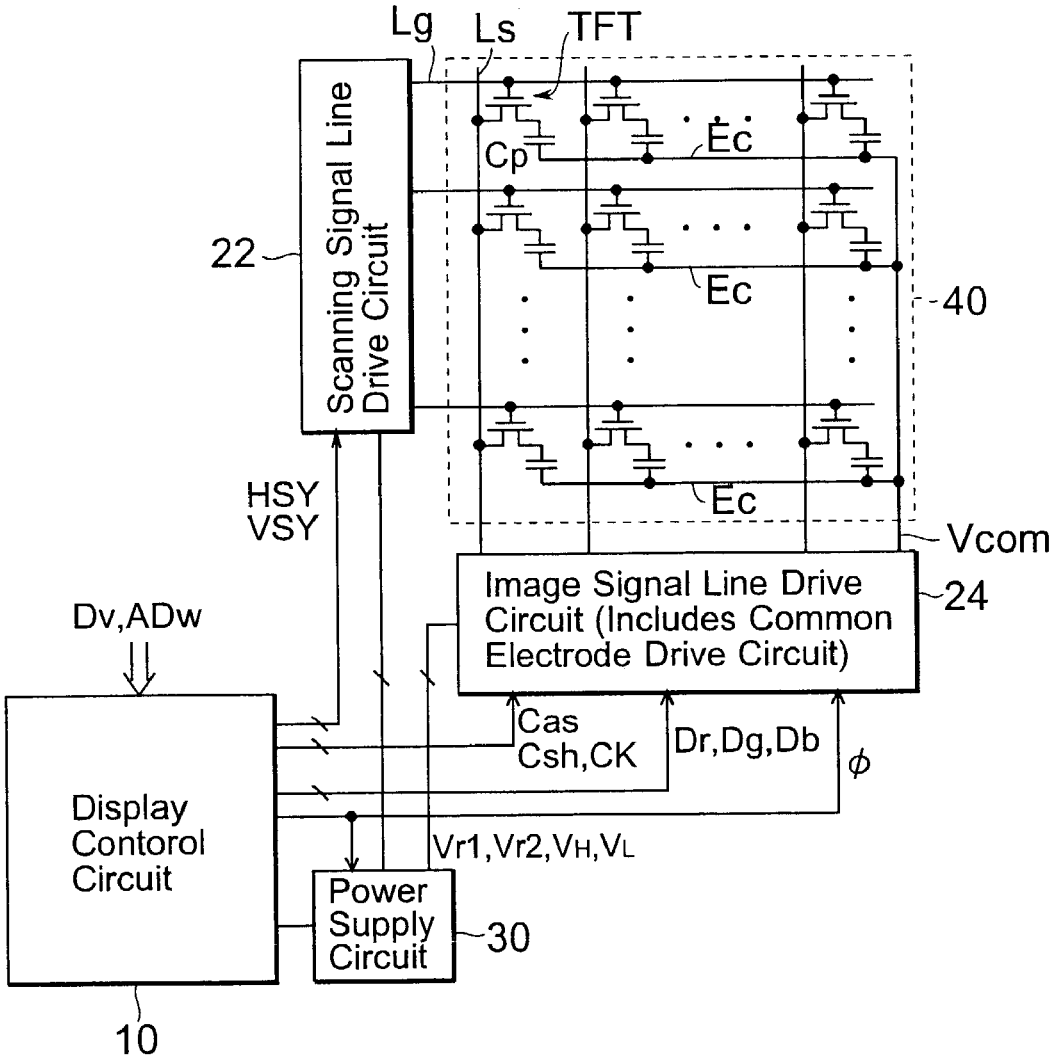
FIG. 12 is a block diagram showing the configuration of a liquid-crystal display according to a third embodiment of the present invention.
Figure 13:
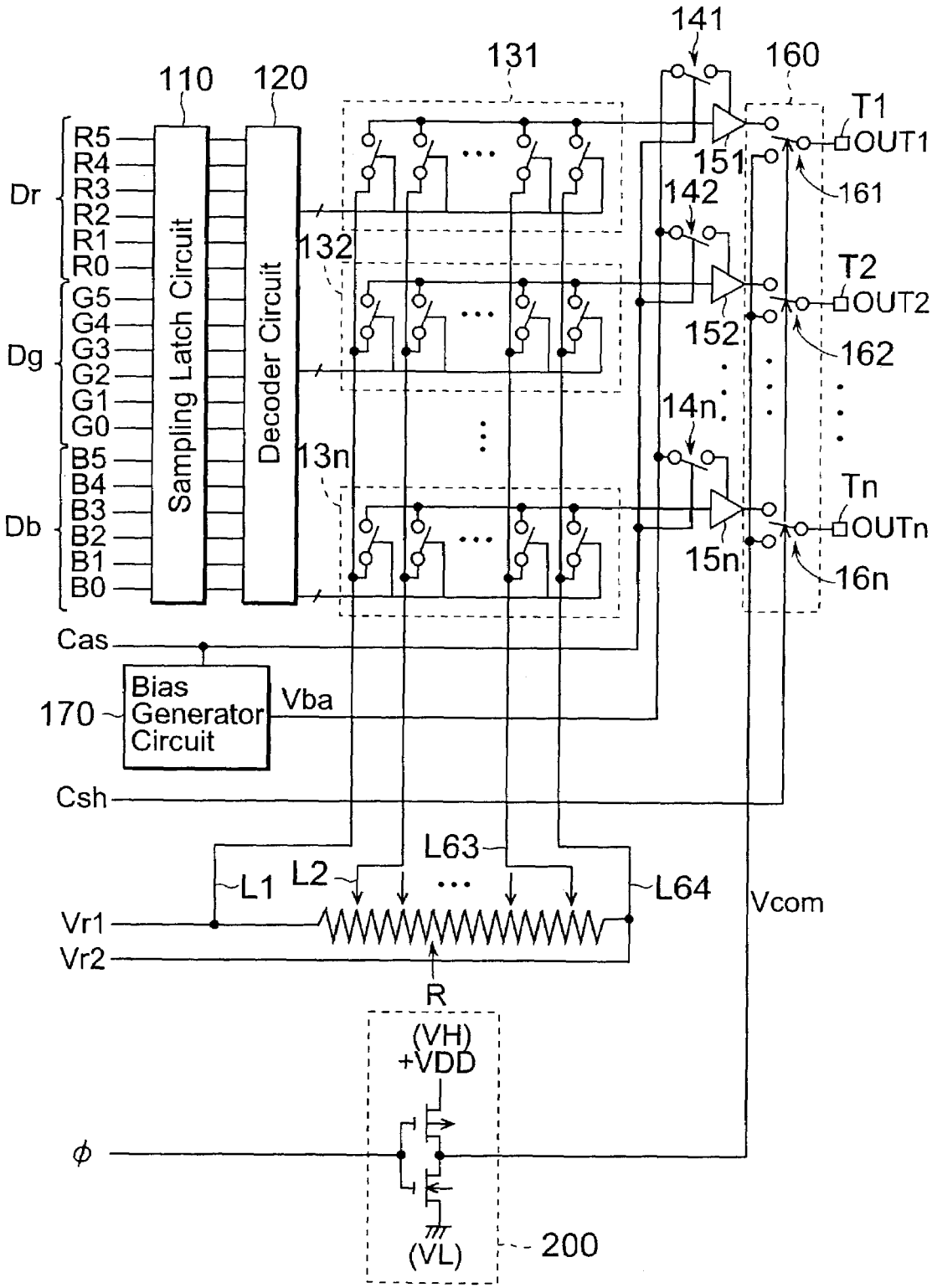
FIG. 13 is a circuit diagram showing the configuration of an image signal line drive circuit in the third embodiment.

FIG. 12 is a block diagram showing the configuration of a liquid-crystal display 40 according to a third embodiment of the present invention. In this liquid-crystal display, a circuit that is equivalent to the common electrode drive circuit 23 in the liquid-crystal display according to the first embodiment shown in FIG. 1 is built into the image signal line drive circuit 24. Therefore, in this embodiment the reference voltages VH and VL and the polarity reversal control signal ϕ for generating the common electrode signal Vcom are supplied to the image signal line drive circuit 24, the common electrode signal Vcom being applied to common electrode Ec of the liquid-crystal panel 40 from the image signal line drive circuit 24. FIG. 13 is a circuit diagram showing the configuration of this image signal line drive circuit 24, which has built therewithin a common electrode drive circuit 200 having the same configuration as the already described circuit shown in FIG. 4A, but is otherwise similar in configuration to the first embodiment, so that corresponding elements to elements in the first embodiment are assigned the same reference numerals and are not explicitly described herein. With regard to the method for driving this liquid-crystal panel 40 as well, since the method is the same as for the first embodiment, the method is not described herein. Because the image signal line drive circuit 24 has a built in common electrode drive circuit 200, the output signal of the common electrode drive circuit 200 is applied as the common electrode signal Vcom to the second terminals of the selector switches 161 to 16*n* in the connection switching circuit 160.

In the above-noted embodiment as well, similar to the case of the first embodiment, when the polarity is reversed as part of AC drive of the liquid-crystal panel 40, the image signal lines Ls in the liquid-crystal panel 40 are electrically separated from the buffer circuits 151 to 15*n* within the image signal line drive circuit 24 and shorted to the common electrode Ec. By doing this, even if buffer circuits having a drive capacity that is smaller than in the past are used as the buffer circuits 151 to 15*n* in the image signal line drive circuit, it is possible to apply a voltage to the liquid-crystal panel that is similar to that applied in the past. Therefore, according to this embodiment, by using a buffer circuit having a drive capacity that is lower than in the past, it is possible to reduce the power consumption of the image signal line drive circuit, and further possible to reduce the size of the transistors used to implement the buffer circuits 151 to 15*n*. As a result, it is possible to achieve a reduction in both the size and the cost of the liquid-crystal display.

As is the case in the first and second embodiments, in the case in which the common electrode signal Vcom is applied to the image signal lines Ls in place of the output signals from the buffer circuit when the polarity is reverse to perform AC drive of the liquid-crystal panel, by packaging the image signal line drive circuit including a common electrode drive circuit on one chip as described above, the configuration of the liquid-crystal display 40 is simplified. There is the same advantage, not only in the case in which the image signal line drive circuit and common electrode drive circuit are implemented as a single chip, but also in the case in which the image signal line drive circuit and the common electrode drive circuit are formed on one and the same substrate making up the liquid-crystal panel.

4. Fourth Embodiment

Figure 14:
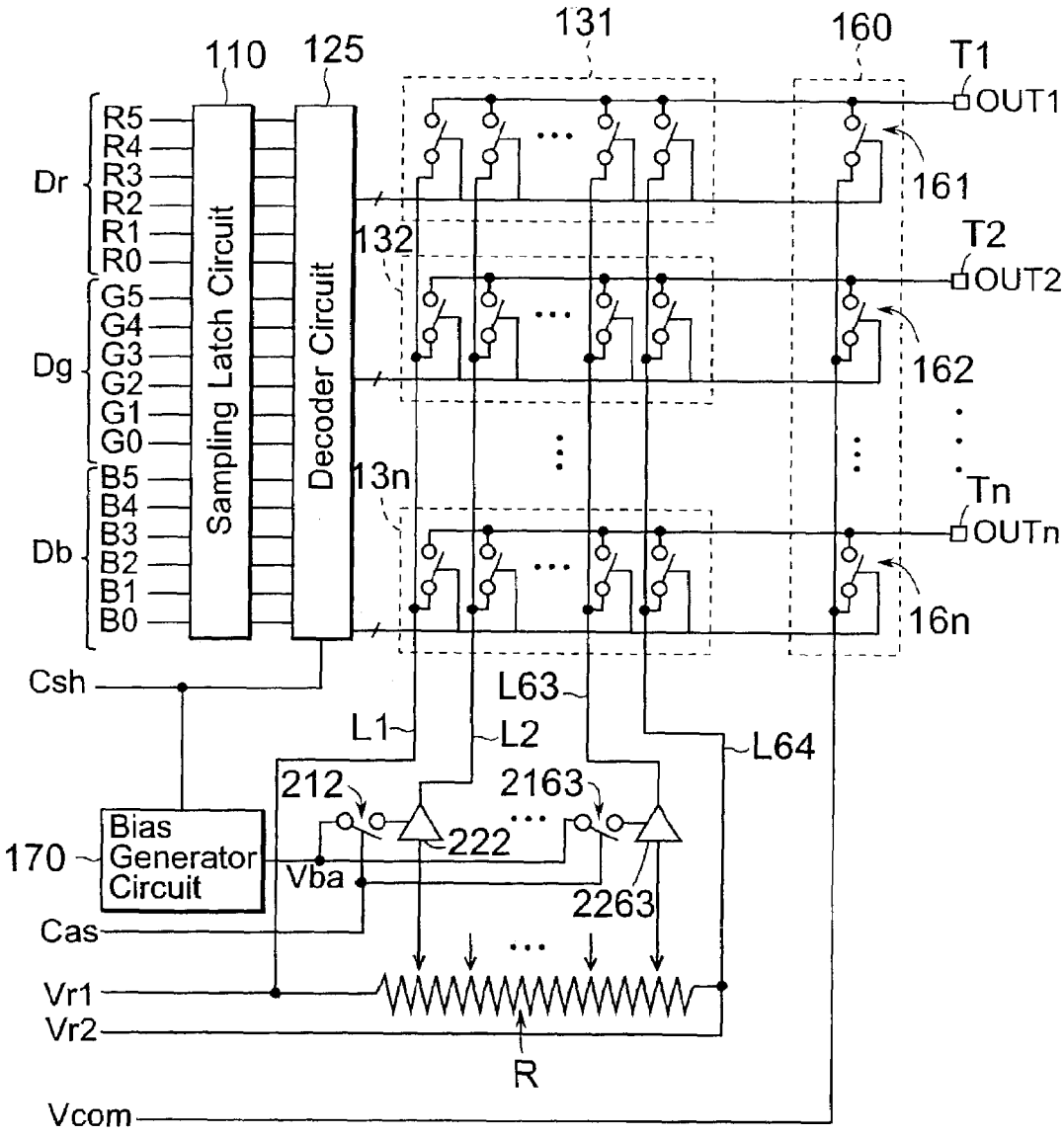
FIG. 14 is a circuit diagram showing the configuration of an image signal line drive circuit in a fourth embodiment of the present invention.

FIG. 14 is a circuit diagram showing the configuration of an image signal line drive circuit in a liquid-crystal display according to a fourth embodiment of the present invention. The liquid-crystal display of this embodiment differs from that of the first embodiment in that, rather than providing the buffer circuits 151 to 15*n* between the reference voltage selection circuits 131 to 13*n* and the connection switching circuits 160 in the image signal line drive circuit, 62 buffer circuits 222 to 2263 are disposed between a voltage divider circuit formed using a resistance R and 62 reference voltage bus lines L2 to L63 for passing the 62 types of reference voltages generated by the voltage divider. An on/off switch is provided as stopping control circuits 212 to 2163 for each of-the buffer circuits 222 to 2263, each of the stopping control circuits 2163 controlling the supply of the amplifier bias Vba to buffer circuits 222 to 2263, based on the amplifier stopping control signal Cas, as shown in FIG. 5D. In this embodiment, the shorting control signal Csh is inputted to a decoder circuit 125, which based on the internal image signals from a sampling latch circuit 110, generates n groups of decoded outputs corresponding to the n image signal lines Ls, respectively. Because other aspects of the configuration of this embodiment are the same as the first embodiment, corresponding elements are assigned the same reference numerals as in the first embodiment, and are not explicitly described herein. Similarly, since the method for driving the liquid-crystal panel 40 is the same as in the first embodiment, this method is not described herein.

During the time when the amplifier bias Vba is being supplied, the buffer circuits 222 to 2263 in the above-described configuration have an extremely high input impedance and an extremely low output impedance, the gain thereof under this condition being substantially one, so that they function as voltage followers. When the amplifier bias Vba supply is stopped, however, the buffer circuits go into the stopped condition, in which the power consumption thereof is small enough to neglect, and in which the output impedance is high. Furthermore, because the first and second reference voltages Vr1 and Vr2 are supplied from the power supply circuit 30, these reference voltages Vr1 and Vr2 are applied to the reference voltage bus lines L1 and L64, respectively, via a buffer circuit. In the image signal line drive circuit in the above-noted configuration, because there is are no buffer circuits between the reference voltage selection circuits 131 to 13*n* and the connection switching circuit 160, the selected reference voltages from the reference voltage selection circuits 131 to 13*n* are applied to the first terminals of the selector switches 161 to 16*n* in the connection switching circuit 160.

In the above-described configuration, the n groups of decoded outputs from the decoder circuit 125 are each made up of 65 signals (number of gradations plus 1), of which 64 signals are inputted to the reference voltage selection circuits 131 to 13*n*. When the shorting control signal Csh is at the low level, similar to the case of the first embodiment, only one of these 64 signals is made active, responsive to the above-noted internal image signals. One remaining signal of each of the n groups of decoded signals is inputted to the selector switches 161 to 16*n* in the connection switching circuit 160. The decoded output signal inputted to the selector switches 161 to 16*n* are inactive when the shorting control signal Csh is at the low level, and are active when the shorting control signal Csh is at the high level. When the shorting control signal Csh is at the high level, all of the signals of the n decoded outputs that are inputted to the reference voltage selection circuits 131 to 13*n* are inactive. Therefore, when the shorting control signal Csh is at the low level, the selected reference voltage outputted from the reference voltage selection circuits 131 to 13*n* in response to the internal image signals from the sampling latch circuit 110 are output from the image signal line drive circuit as the output signals OUT1 to OUTn, and are supplied to the image signal lines Ls of the liquid-crystal panel 40. When the shorting control signal Csh is at the high level, however, the common electrode signal Vcom is supplied to each of the image signal lines Ls of the liquid-crystal panel 40. This means that there is a shorting between the common electrode Ec and the image signal lines Ls when the shorting control signal Csh is at the high level. In an image signal line drive circuit such as this, the reference voltage selection circuit includes the connection switching circuit 160 and in the reference voltage selection circuit thereof, it can be thought that one voltage is selected for each image signal line from the 65 types of voltages made up of the 64 types reference voltages corresponding to the number of gradations and the common electrode signal Vcom, the selected voltage being output as the output signals OUT1 to OUTn.

In the above-described embodiment as well, similar to the case of the first embodiment, when the polarity is reversed as part of AC drive of the liquid-crystal panel 40, the image signal lines Ls in the liquid-crystal panel 40 are electrically separated from each of the reference voltage selection circuits 131 to 13*n* and each of the buffer circuits 222 to 2263 within the image signal line drive circuit and are shorted to the common electrode Ec. By doing this, even if buffer circuits having a drive capacity that is smaller than in the past are used as the buffer circuits 222 to 2263 in the image signal line drive circuit, it is possible to apply a voltage to the liquid-crystal panel that is similar to that applied in the past. Therefore, according to this embodiment, by using a buffer circuit having a drive capacity that is lower than in the past, it is possible to reduce the power consumption of the image signal line drive circuit, and further possible to reduce the size of the transistors used to implement the buffer circuits 222 to 2263. As a result, it is possible to achieve a reduction in both the size and the cost of the liquid-crystal display. Additionally, similar to the case of the first embodiment, because the buffer circuits 222 to 2263 and the bias generator circuit 170 are in the stopped condition because of the amplifier stopping control signal for the shorting interval or for a prescribed time interval including the shorting interval (refer to FIG. 5A to FIG. 5D), this also contributes to a reduction of the power consumption of the image signal line drive circuit.

In addition to the above, in this embodiment, because the configuration is such that the common electrode signal Vcom can be treated as one of the reference voltages, with one of the 65 reference voltages selected, that is, the configuration is such that the connection switching circuit 160 is included within the reference voltage selection circuit, compared to a configuration such as shown in FIG. 3, in which the group of switches as the reference voltage selection circuits 131 to 13*n*, the group of switches as the buffer circuits 151 to 15*n* and the reference voltage selection circuit 160 are disposed in order, it is possible to achieve a compact circuit configuration in the image signal line drive circuit. For this reason, according to this embodiment it is possible to implement an image signal line drive circuit achieving the same type of effect as the first embodiment on a small IC chip, resulting in a more compact and lower-cost liquid-crystal display.

5. Fifth Embodiment

Figure 15:
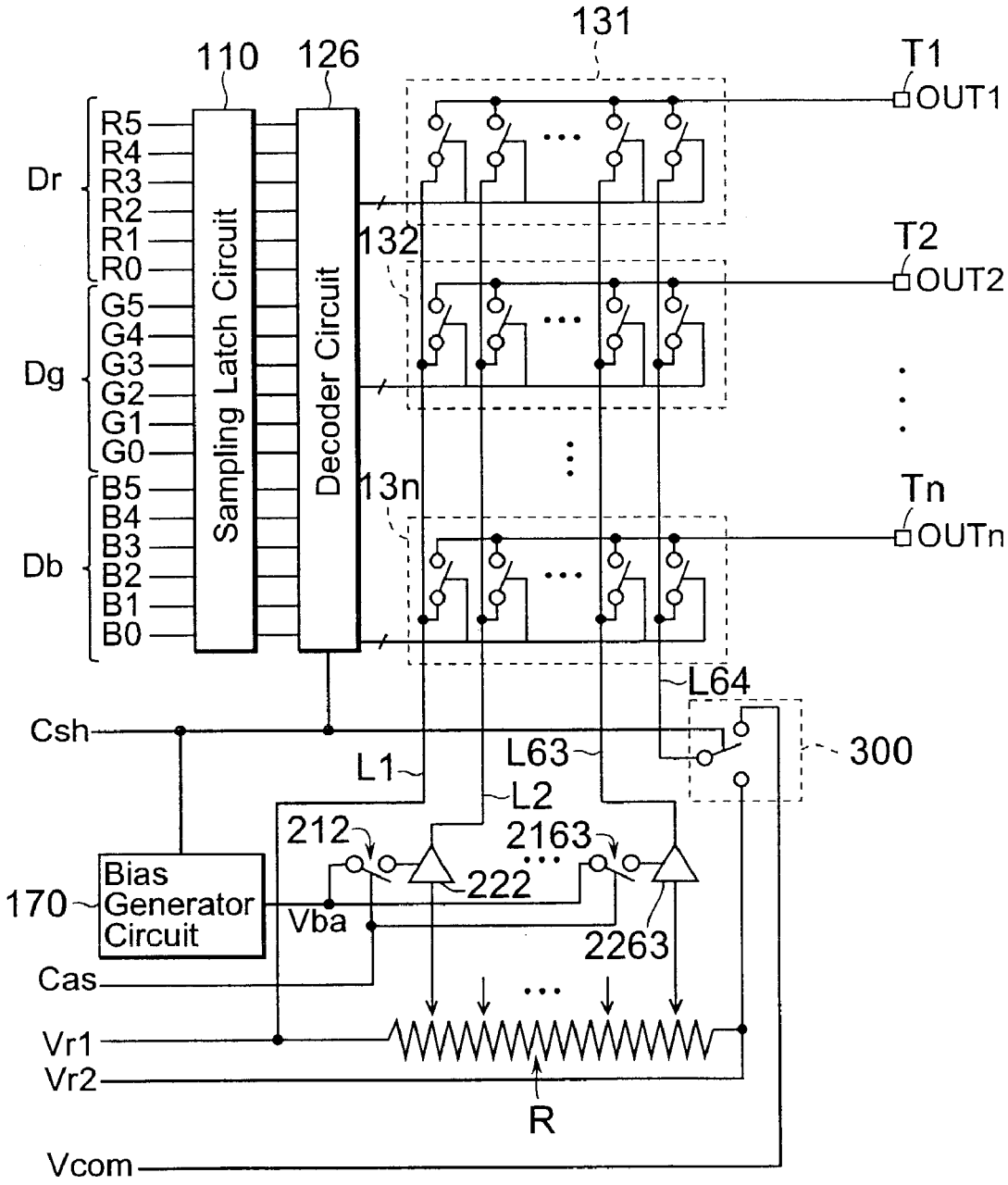
FIG. 15 is a circuit diagram showing the configuration of an image signal line drive circuit in a fifth embodiment of the present invention.

FIG. 15 is a circuit diagram showing the configuration of an image signal line drive circuit in a liquid-crystal display according to a fifth embodiment of the present invention. This liquid-crystal display, rather than the connection switching circuit 160 that is provided in the output section of the image signal line drive circuit of the fourth embodiment, is provided with a voltage switching circuit 300 formed by one selector switch, a reference voltage Vr2 supplied from an external power supply circuit being applied to the reference voltage bus line L64 via this voltage switching circuit 300. The shorting control signal Csh is inputted to this voltage switching circuit 300 as a control signal to control the switching thereof. Because other aspects of the configuration of this embodiment are basically the same as the fourth embodiment, corresponding elements are assigned the same reference numerals as in the fourth embodiment and are not explicitly described herein. The method for driving the liquid-crystal panel 40, being the same as that of the first embodiment, is also not described herein.

In the image signal line drive circuit of this embodiment, a decoder circuit 126 is substantially the same as the decoder circuit 125 in the fourth embodiment, with the exception that the operation occurs when the shorting control signal Csh is at the high level. That is, when the shorting control signal Csh is at the high level, whereas in the fourth embodiment all the decoded output signals inputted to the reference voltage selection circuits 131 to 13*n* are inactive, in this embodiment of the switches in the reference voltage selection circuits 131 to 13*n*, only the decoded output inputted to a switch that is connected to the reference voltage bus line L64 is active.

In the image signal line drive circuit of this embodiment, the voltage switching circuit 300 has a first terminal, a second terminal, and a third terminal, the reference voltage bus line L64 being connected to the first terminal, the reference voltage Vr2 being connected to the second terminal, and the common electrode signal Vcom being connected to the third terminal. The voltage switching circuit 300 makes connection of the first terminal to the second terminal when the shorting control signal Csh is at the low level, and makes connection of the first terminal to the third terminal when the shorting control signal Csh is at the high level. By doing this, with respect to the reference voltage bus line L64, when the shorting control signal Csh is at the low level the reference voltage Vr2 is provided, and when the shorting control signal Csh is at the high level the common electrode signal Vcom is provided.

Therefore, when the shorting control signal Csh is at the low level, in response to the internal image signals from the sampling latch circuit 110, the selected reference voltages outputted from the reference voltage selection circuits 131 to 13*n* are supplied as the output signals OUT1 to OUTn respectively to the image signal lines Ls of the liquid-crystal panel 40 from the image signal line drive circuit. If the shorting control signal Csh is at the high level, however, the common electrode signal Vcom is supplied to the liquid-crystal panel 40 via the reference voltage selection circuits 131 to 13*n*. This means that when the shorting control signal Csh is at the high level there is shorting between the common electrode Ec and the image signal lines Ls.

In the above-described embodiment as well, it is possible to achieve an effect similar to the fourth embodiment. That is even if buffer circuits having a small drive capacity are used as the buffer circuits 222 to 2263 in the image signal line drive circuit, it is possible to apply a voltage to the liquid-crystal panel that is similar to that applied in the past. Additionally, it is possible to reduce the size of the transistors used to implement the buffer circuits 222 to 2263. Additionally, because the buffer circuits 222 to 2263 and the bias generator circuit 170 are in the stopped condition because of the amplifier stopping control signal Cas for the shorting interval or for a prescribed time interval including the shorting interval (refer to FIG. 5A to FIG. 5D), this also contributes to a reduction of the power consumption of the image signal line drive circuit. Furthermore, there is the advantage, compared with the first embodiment, of a reduction in the number of buffer circuits required.

In this embodiment, of the 64 reference voltage bus lines one bus line, L64, is shared between passing the reference voltage Vr2 and passing the common electrode signal Vcom, and furthermore in place of the connection switching circuit 160 of the earlier described embodiments, one switch in the reference voltage selection circuits 131 to 13*n* is used. With this configuration, compared with the configuration in which the shorting operation is performed by a connection switching circuit 160 made up of n selector switches 161 to 16*n*, although one switch having a low on resistance is required as the voltage switching circuit 300, the need for the connection switching circuit 160 is eliminated, thereby eliminating the need for a large amount of wiring for control signals. For this reason, this embodiment, in addition to achieving the above-noted effects, has the effect of enabling a further reduction in the size of an IC chip used to implement the image signal line drive circuit.

6. Sixth Embodiment

Figure 16:
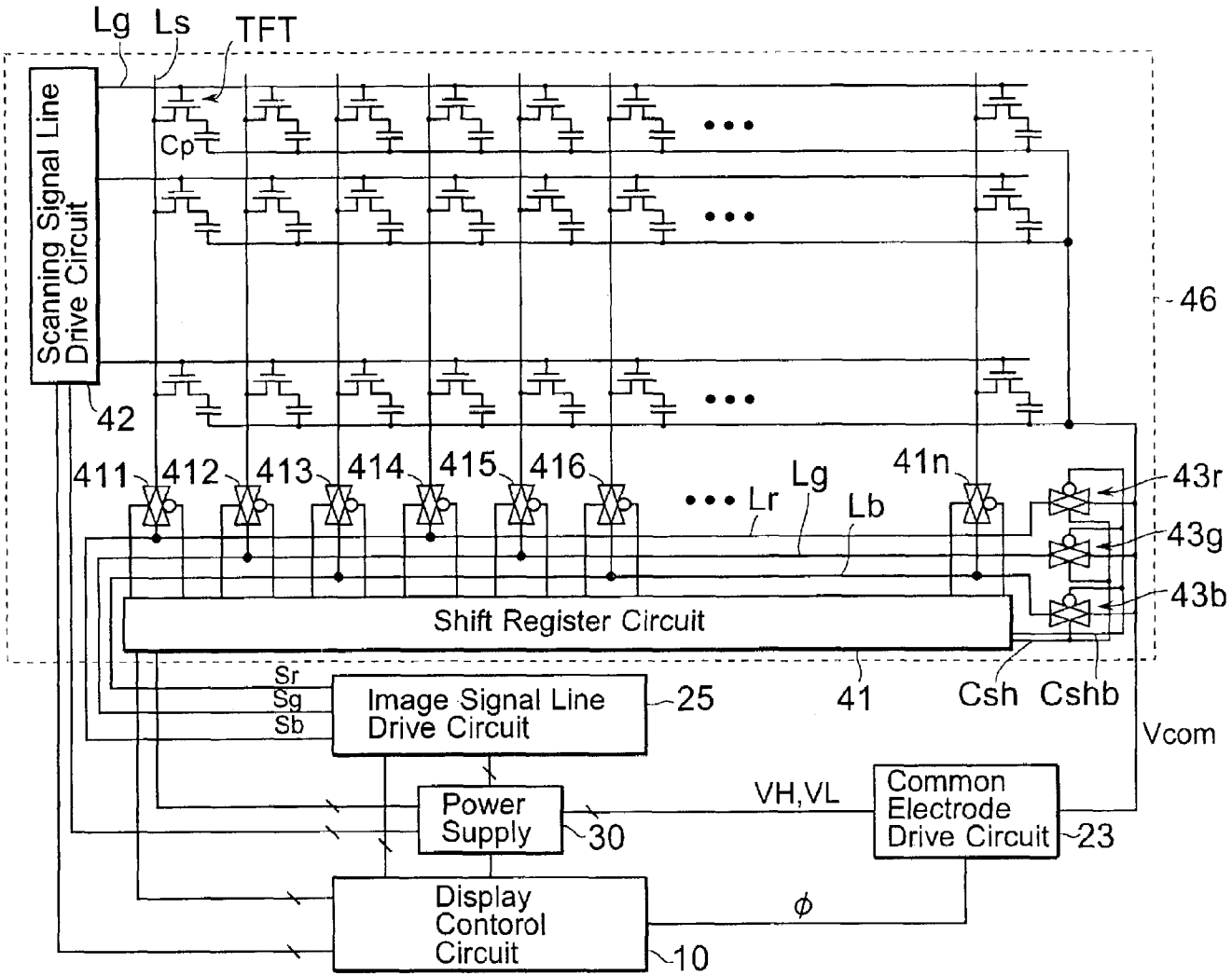
FIG. 16 is a circuit diagram showing the configuration of a liquid-crystal display according to a sixth embodiment of the present invention.

FIG. 16 shows the configuration of a liquid-crystal display according to a sixth embodiment of the present invention, as a combination of a block diagram and a circuit diagram. In the description below, constituent elements and signals that are the same as the above-noted embodiment are assigned the same reference numerals and will not be explicitly described herein.

The liquid-crystal display according to this embodiment is an analog-driver type liquid-crystal display, having a display control circuit 10, a common electrode drive circuit 23, and a power supply circuit 30 configured the same as in the first embodiment, but differing therefrom with regard to an image signal line drive circuit 25 and a liquid-crystal panel 46.

The image signal line drive circuit 25 generates a red image signal Sr, which is an analog signal representing the red component of an image to be displayed, a green image signal Sg, which is an analog signal representing the green component of an image to be displayed, and a blue image signal Sb, which is an analog signal representing the blue component of an image to be displayed. These analog image signals Sr, Sg, and Sb are polarity-reversed every one horizontal synchronization interval to achieve AC drive.

The liquid-crystal panel 46 is an active-matrix display panel having as switching elements TFTs using polysilicon, and having a pair of mutually opposing substrates (hereinafter referred to as the first substrate and the second substrate). These substrates are held fixed with a prescribed distance therebetween (typically several μm), with a liquid crystal material forming a liquid-crystal layer so as to fill the space between the substrates. At least one of these substrates is transparent. On the first substrate is disposed a plurality of image signal lines Ls (the number of image signal lines below taken to be n) and a plurality of scanning signal lines Lg, in a lattice arrangement, and a plurality of pixel formation parts, disposed in a matrix arrangement, each corresponding to one of points of intersection between the plurality of image signal lines Ls and the plurality of scanning signal lines Lg. Each of the pixel formation parts has a TFT, the source terminal of which is connected to an image signal line Ls and the gate terminal of which is connected to a scanning signal line Lg, a pixel electrode connected to the drain terminal of the TFT, a common electrode, provided in common to the plurality of pixel formation parts and, formed over the entire surface of the second substrate as an opposing electrode, so that a capacitance Cp is formed between the common electrode and the pixel electrode, and a liquid-crystal layer provided in common to all the pixel electrodes and sandwiched between the pixel electrodes and the common electrode. In addition to the above, on the first substrate of the liquid-crystal panel 46, there is formed a scanning signal line drive circuit 42, which supplies a scanning signal to the plurality of scanning signal lines Lg, image signal bus lines Lr, Lg, and Lb for the purpose of passing analog image signals Sr, Sg, and Sb from the image signal line drive circuit 25, a sampling circuit formed by n analog switches 411 to 41*n* for sampling the analog image signals Sr, Sg, and Sb passed by these image signal bus lines Lr, Lg, and Lb and supplying them to the plurality of image signal lines Ls, and a connection switching circuit for shorting the image signal line bus lines Lr, Lg, and Lb to the common electrode at the time of polarity reversal. In the liquid-crystal panel 46, therefore, the plurality of pixel formation part disposed in a matrix arrangement, the image signal lines Ls and scanning signal lines Lg formed in a lattice arrangement, and part of the drive circuit are formed as one.

In a liquid-crystal panel configured as described above, a shift register circuit 41 sequentially sends one pulse from an input terminal to an output terminal during one horizontal synchronization interval, and also generates a shorting control signal Csh that is at the high level for a prescribed amount of time at the time of polarity reversal, this being a signal at the high level each time the above-noted pulse reaches the output terminal, and the inverted shorting control signal Cshb which is derived by inverting the signal Csh.

The n analog switches 411 to 41*n* of the sampling circuit are sequentially turned on by a pulse that is transferred by the shift register circuit 41, the result of this on operation being that the analog image signals Sr, Sg, and Sr on the image signal bus lines Lr, Lg, and Lb are supplied to the image signal lines Ls, and passed to the pixel electrodes via TFTs that have been turned on by the scanning signal line drive circuit 42.

The connection switching circuit includes three analog switches 43*r*, 43*g*, and 43*b* provided for the respective image signal bus lines Lr, Lg, and Lb and inserted between the respective image signal bus lines Lr, Lg, and Lb and a signal line that passes the common electrode signal Vcom. These analog switches 43*r*, 43*g*, and 43*b* input the above-noted shorting control signal Csh and inverted shorting control signal Cshb as control signals. By doing this, the image signal bus lines Lr, Lg, and Lb are supplied with the common electrode signal Vcom only during the time interval in which the shorting control signal Csh is at the high level. This means that the image signal bus lines Lr, Lg, and Lb are shorted to the common electrode only when the shorting control signal Csh is at the high level (that is, only during a prescribed amount of time when polarity reversal occurs).

As described above, the image signal line drive circuit 25 supplies the analog image signals Sr, Sg, and Sb with polarity reversed every one horizontal synchronization interval to the image signal bus lines Lr, Lg, and Lb in the liquid-crystal panel 46. During at least the shorting interval, however, for example by placing the output of a buffer circuit within the image signal line drive circuit 25 in the high-impedance state, the image signal drive circuit 25 is electrically separated from the image signal bus lines Lr, Lg, and Lb. Because the image signal bus lines Lr, Lg, and Lb are formed on the first substrate an the common electrode is formed over the entire surface of the second substrate, although not shown in the drawing, a capacitance is formed between the image signal bus lines Lr, Lg, and Lb and the common electrode. The image signal line drive circuit 25 of this embodiment therefore is the same as the image signal line drive circuits of the earlier described embodiments in that the image signal line drive circuit drives the capacitive load by supplying the capacitive load with a signal which has its polarity reversed for each fixed period.

In this embodiment, as described earlier, by a connection switching circuit formed by three analog switches 43*r*, 43*g*, and 43*b*, the image signal bus lines Lr, Lg, and Lb are shorted to the common electrode for a prescribed amount of time (the time interval during which the shorting control signal Csh is at the high level) each time the polarity of the analog image signals Sr, Sg, and Sb passed by the image signal lines Lr, Lg, and Lb is reversed, during which time the image signal line drive circuit 25 is electrically separated form the image signal bus lines Lr, Lg, and Lb. Therefore, similar to other previously described embodiments, even if a buffer circuit having a lower drive capacity than in the past is used as the buffer circuit in the image signal line drive circuit 25, it is possible to supply to the image signal bus lines Lr, Lg, and Lb signals that are the same as in the past. For this reason, according to this embodiment by using a buffer circuit having a smaller drive capacity that in the past, it is possible to reduce the power consumption of the image signal line drive circuit 25, and further possible to reduce the size of the transistors used to implement the buffer circuits 151 to 15*n*. As a result, it is possible to achieve a reduction in both the size and the cost of the liquid-crystal display.

(7. Variations)

It will be understood that the foregoing descriptions do not restrict the present invention, and that it is possible to make other variations of the present invention within the scope of the present invention. For example, although in the above embodiments the polarity of the signals (voltages) supplied to the image signal lines Ls and those supplied to the image signal bus lines Lr, Lg, and Lb relative to the common electrode potential as a reference are reversed every one horizontal synchronization interval, the period for polarity reversal is not restricted to one horizontal synchronization interval, and can for example be made two horizontal synchronization intervals. In this case as well, when the polarity is reversed a shorting operation as described above is performed so as to reduce the required buffer circuit drive capacity, thereby enabling a reduction in the power consumption of the image signal line drive circuit and in the size of the circuit.

Additionally, whereas in the first to the fifth embodiments the amplifier stopping control signal Cas stops the buffer circuit and bias generator circuit so as to reduce power consumption, it is alternatively possible not to stop these circuits, or to cause the bias generator circuit to operate at all times, and stop only the buffer circuits. In the case of not stopping the buffer circuits, however, it is preferable to perform output control so that the output of each buffer circuit is in the high-impedance state during the shorting interval.

It will further be understood that the above embodiments are described in the form of examples of liquid-crystal displays, and that the present invention can be applied as well to other display devices in which a voltage signal that is polarity reversed with a prescribed period is supplied to a capacitive load so as to drive the capacitive load. Also, although the above-described embodiments the potential on the common electrode (common electrode signal Vcom) is AC driven in order to reduce the amplitude of the voltage on the image signal lines Ls, the present invention can also be applied in the case in which the potential on the common electrode is fixed, for example the case of a drive method in which polarity reversal of the voltage applied across the liquid-crystal layer is performed for each one horizontal synchronization interval and for each image signal line while performed for each frame, this being dot reversal drive.

While the invention has been described in detail, the foregoing description is in all aspects illustrative and not restrictive. It is understood that numerous other modifications and variations can be devised without departing from the scope of the invention.

The present application is based on a claim for priority deriving from the Japanese patent application 2002-031593, titled "Image display device and drive circuit and drive method for same" filed on Feb. 8, 2002, the content of which is incorporated herein by reference.

What is claimed is:

1. A display device in which a voltage serving as an image signal representing part of an image to be displayed is applied to a capacitive load including a capacitance formed by mutually opposing first and second electrodes, and which has a drive circuit that causes the voltage applied to the capacitive load to reverse polarity periodically, the display device comprising:

a common electrode drive circuit for supplying a voltage $V_{COM}$ to the second electrode;

an image signal line drive circuit for supplying a voltage signal to the first electrode;

a connection switching circuit, when the polarity of the voltage applied to the capacitive load is reversed, for electrically separating the first electrode from the image signal line drive circuit and shorting the first electrode to an electrode providing a voltage level that is equivalent to the voltage supplied to the second electrode during a shorting interval; and wherein during the shorting interval an amplitude of $V_{COM}$ being supplied to the second electrode changes from a first value to a second value at a time when the first electrode is shorted to the electrode providing the voltage level that is equivalent to the voltage supplied to the second electrode.

2. A display device according to claim 1, wherein the electrode providing a voltage level that is equivalent to the voltage supplied to the second electrode is the second electrode.

3. A display device according to claim 1, wherein the drive circuit applies as the image signal to the capacitive load a voltage representing an image to be displayed based on a horizontal scan and a vertical scan, and causes the polarity of the applied voltage to be reversed at the time of switching of a scan line in the horizontal scan.

4. A display device according to claim 3, further comprising:

a plurality of image signal lines serving as the first electrode, a plurality of scanning signal lines intersecting with the plurality of image signal lines, a plurality of pixel formation parts each corresponding to one of points of intersection between the plurality of image signal lines and the plurality of scanning signal lines, and disposed in a matrix arrangement, and a scanning signal line drive circuit for selectively driving the plurality of scanning signal lines, wherein each pixel formation part comprises a switching element that is switched on and off by a scanning signal line passing through a corresponding intersection point, a pixel electrode connected via the switching element to an image signal line passing through the corresponding intersection point, and a common electrode serving as the second electrode, providing in common to the plurality of pixel formation parts, and disposed so that a prescribed capacitance included in the capacitive load is formed between the common electrode and the pixel electrode, wherein the scanning signal line drive circuit applies to a selected scanning signal line a voltage that turns the switching element on, and the connection switching circuit, when the polarity of the voltage applied to the capacitive load is reversed, electrically separates the image signal lines from the image signal line drive circuit and shorting the image signal lines to an electrode providing a voltage level that is equivalent to the voltage supplied to the common electrode.

5. A display device according to claim 4, wherein the connection switching circuit, after the switching element that had been turned on by the scanning line selected before reversal of the polarity of the voltage applied to the capacitive load is placed in the off state, electrically separates the image signal lines from the image signal line drive circuit and shorts the image signal lines to an electrode providing a voltage level that is equivalent to the voltage supplied to the common electrode.

6. A display device according to claim 4, wherein the connection switching circuit, when the polarity of the voltage applied to the capacitive load is reversed, shorts the image signal lines to an electrode providing a voltage level that is equivalent to the voltage supplied to the common electrode for a period of time that is three or more times the delay time constant which is the product of the wiring resistance and wiring capacitance in one image signal line.

7. A display device according to claim 4, wherein the image signal line drive circuit includes a stopping control circuit for stopping at least part of the image signal line drive circuit for at least the period of time during which the connection switching circuit is shorting the image signal lines to an electrode providing a voltage level equivalent to the voltage supplied by the common circuit.

8. A display device according to claim 4, wherein the image signal line drive circuit includes a reference voltage selection circuit provided correspondingly for each of the image signal lines, for selecting a voltage responsive to the image signal from a plurality of reference voltages and supplying the selected voltage to the corresponding image signal line as the voltage signal, and wherein each of the reference voltage selection circuits includes the connection switching circuit, and when the polarity of the voltage applied to the capacitive load is reversed, selects a voltage level equivalent to the common electrode signal that is the voltage supplied to common electrode, instead of a reference voltage from the plurality of reference voltages, and supplies the selected voltage level to a corresponding image signal line, thereby shorting each of the image signal lines to an electrode providing a voltage level equivalent to the voltage supplied to the common electrode.

9. A display device according to claim 8, wherein the image signal line drive circuit further comprises:

a plurality of reference voltage bus lines to which are given the plurality of reference voltages, respectively; and a voltage switching circuit, when the polarity of the voltage applied to the capacitive load is reversed, for applying to one reference voltage bus line of the plurality of reference voltage bus lines a voltage level equivalent to the common electrode signal, instead of the reference voltage to be applied to the one reference voltage bus line, and wherein each of the reference voltage selection circuits, during each horizontal scan period, selects a reference voltage bus line of the plurality of reference voltage bus lines to which is applied a reference voltage responsive to the image signal and connects the selected bus line to a corresponding image signal line and, when the polarity of the voltage applied to the capacitive load is reversed, selects and connects the one reference voltage bus line to the corresponding image signal line.

10. A display device according to claim 9, wherein the voltage level equivalent to the common electrode signal is the common electrode signal.

11. A display device according to claim 4, wherein the electrode providing a voltage level that is equivalent to the voltage supplied to the common electrode is the common electrode signal.

12. A display device according to claim 4, wherein the drive circuit further comprises:

a common electrode drive circuit for switching the potential of the common electrode in response to the reversal of polarity of the voltage applied to the capacitive load, wherein the image signal line drive circuit and the common electrode drive circuit are formed on either one and the same substrate or one and the same chip.

13. A drive circuit in a display device of the AC drive type, in which a voltage serving as an image signal representing at least part of an image to be displayed is applied to a capacitive load including a capacitance formed by mutually opposing first and second electrodes, and in which the polarity of the voltage applied to the capacitive load is periodically reversed, the drive circuit comprising:

a common electrode drive circuit for supplying a voltage $V_{COM}$ to the second electrode;

an image signal line drive circuit for supplying a voltage signal to the first electrode, and a connection switching circuit, when the polarity of the voltage applied to the capacitive load is reversed, for electrically separating the first electrode from the image signal line drive circuit and shorting the first electrode to an electrode providing a voltage level that is equivalent to the voltage supplied to the second electrode during a shorting interval; and wherein during the shorting interval, an amplitude of $V_{COM}$ being supplied to the second electrode changes from a first value to a second value at a time when the first electrode is shorted to the electrode providing the voltage level that is equivalent to the voltage supplied to the second electrode.

14. A drive circuit according to claim 13, wherein the electrode providing a voltage level that is equivalent to the voltage supplied to the second electrode is the second electrode.

15. A method for driving by means of a driving circuit in a display device of the AC drive type, in which a voltage serving as an image signal representing at least part of an image to be displayed is applied to a capacitive load including a capacitance formed by mutually opposing first and second electrodes, and in which the polarity of the voltage applied to the capacitive load is periodically reversed, the method comprising:

providing a common electrode drive circuit for supplying a voltage $V_{COM}$ to the second electrode;

a step of supplying a voltage signal to the first electrode, and a step of, when the polarity of the voltage applied to the capacitive load is reversed, electrically separating the first electrode from the part of the drive circuit that supplies the voltage signal to the first electrode, and shorting the first electrode to an electrode providing a voltage level that is equivalent to the voltage supplied to the second electrode during a shorting interval; and wherein during the shorting interval, an amplitude of $V_{COM}$ being supplied to the second electrode changes from a first value to a second value at a time when the first electrode is shorted to the electrode providing the voltage level that is equivalent to the voltage supplied to the second electrode.

16. A method according to claim 15, wherein the electrode providing a voltage level that is equivalent to the voltage supplied to the second electrode is the second electrode.

17. A display device in which a voltage serving as an image signal representing part of an image to be displayed is applied to a capacitive load including a capacitance formed by mutually opposing first and second electrodes, and which has a drive circuit that causes the voltage applied to the capacitive load to reverse polarity periodically, the display device comprising:

a common electrode drive circuit for supplying a voltage $V_{COM}$ to the second electrode;

an image signal line drive circuit for supplying a voltage signal to the first electrode;

a polarity switching control circuit which outputs a polarity revere control signal to the drive circuit which causes the voltage applied to the capacitive load to reverse;

a connection switching circuit for receiving output of a buffer from the image signal line drive circuit and, when the polarity of the voltage applied to the capacitive load is reversed, for electrically separating the first electrode from the image signal line drive circuit and shorting the first electrode to an electrode providing a voltage level that is equivalent to the voltage supplied to the second electrode during a shorting interval;

wherein an output of the buffer switches between a high impedance state and a low impedance state; and wherein the polarity switching control circuit outputs a shorting control signal to the connection switching circuit at a timing so that an output of the buffer is in a high impedance state during at least part of the shorting interval.

18. A method of driving a display device in which a voltage serving as an image signal representing part of an image to be displayed is applied to a capacitive load including a capacitance formed by mutually opposing first and second electrodes, and which has a drive circuit that causes the voltage applied to the capacitive load to reverse polarity periodically, the method comprising:

supplying a voltage $V_{COM}$ to the second electrode;

supplying a voltage signal to the first electrode;

providing a polarity switching control circuit that outputs a polarity revere control signal to cause the voltage applied to the capacitive load to reverse;

providing a connection switching circuit for receiving output of a buffer from the image signal line drive circuit and, when the polarity of the voltage applied to the capacitive load is reversed, and electrically separating the first electrode from an image signal line drive circuit and shorting the first electrode to an electrode providing a voltage level that is equivalent to the voltage supplied to the second electrode during a shorting interval;

switching an output of the buffer between a high impedance state and a low impedance state; and outputting a shorting control signal at a timing so that an output of the buffer is in a high impedance state during at least part of the shorting interval.

19. A display device in which a voltage serving as an image signal representing an image to be displayed is applied to a capacitive load including a capacitance formed by mutually opposing first and second electrodes, and which has a drive circuit that causes the voltage applied to the capacitive load to reverse polarity periodically, the display device comprising:

a plurality of image signal lines serving as the first electrode, a plurality of scanning signal lines intersecting with the plurality of image signal lines, a plurality of pixel formation parts each corresponding to one of points of intersection between the plurality of image signal lines and the plurality of scanning signal lines, and disposed in a matrix arrangement, a scanning signal line drive circuit for selectively driving the plurality of scanning signal lines, an image signal line drive circuit for supplying voltage signals to the plurality of image signal lines, and a connection switching circuit, when the polarity of the voltage applied to the capacitive load is reversed, for electrically separating the plurality of image signal lines from the image signal line drive circuit and shorting the plurality of image signal lines to an electrode providing a voltage level that is equivalent to the voltage supplied to the second electrode, wherein the drive circuit applies as the image signal to the capacitive load a voltage representing an image to be displayed based on a horizontal scan and a vertical scan, and causes the polarity of the applied voltage to be reversed at the time of switching of a scan line in the horizontal scan, wherein each pixel formation part comprises a switching element that is switched on and off by a scanning signal line passing through a corresponding intersection point, a pixel electrode connected via the switching element to an image signal line passing through the corresponding intersection point, and a common electrode serving as the second electrode, providing in common to the plurality of pixel formation parts, and disposed so that a prescribed capacitance included in the capacitive load is formed between the common electrode and the pixel electrode, wherein the scanning signal line drive circuit applies to a selected scanning signal line a voltage that turns the switching element on, and wherein the connection switching circuit, when the polarity of the voltage applied to the capacitive load is reversed, shorts the image signal lines to an electrode providing a voltage level that is equivalent to the voltage supplied to the common electrode for a period of time that is three or more times the delay time constant which is the product of the wiring resistance and wiring capacitance in one image signal line.

20. A display device in which a voltage serving as an image signal representing an image to be displayed is applied to a capacitive load including a capacitance formed by mutually opposing first and second electrodes, and which has a drive circuit that causes the voltage applied to the capacitive load to reverse polarity periodically, the display device comprising:

a plurality of image signal lines serving as the first electrode, a plurality of scanning signal lines intersecting with the plurality of image signal lines, a plurality of pixel formation parts each corresponding to one of points of intersection between the plurality of image signal lines and the plurality of scanning signal lines, and disposed in a matrix arrangement, a scanning signal line drive circuit for selectively driving the plurality of scanning signal lines, an image signal line drive circuit for supplying voltage signals to the plurality of image signal lines, and a connection switching circuit, when the polarity of the voltage applied to the capacitive load is reversed, for electrically separating the plurality of image signal lines from the image signal line drive circuit and shorting the plurality of image signal lines to an electrode providing a voltage level that is equivalent to the voltage supplied to the second electrode, wherein the drive circuit applies as the image signal to the capacitive load a voltage representing an image to be displayed based on a horizontal scan and a vertical scan, and causes the polarity of the applied voltage to be reversed at the time of switching of a scan line in the horizontal scan, wherein each pixel formation part comprises a switching element that is switched on and off by a scanning signal line passing through a corresponding intersection point, a pixel electrode connected via the switching element to an image signal line passing through the corresponding intersection point, and a common electrode serving as the second electrode, providing in common to the plurality of pixel formation parts, and disposed so that a prescribed capacitance included in the capacitive load is formed between the common electrode and the pixel electrode, wherein the scanning signal line drive circuit applies to a selected scanning signal line a voltage that turns the switching element on, wherein the image signal line drive circuit includes a reference voltage selection circuit provided correspondingly for each of the image signal lines, for selecting a voltage responsive to the image signal from a plurality of reference voltages and supplying the selected voltage to the corresponding image signal line as the voltage signal, and wherein each of the reference voltage selection circuits includes the connection switching circuit, and when the polarity of the voltage applied to the capacitive load is reversed, selects a voltage level equivalent to the common electrode signal that is the voltage supplied to common electrode, instead of a reference voltage from the plurality of reference voltages, and supplies the selected voltage level to a corresponding image signal line, thereby shorting each of the image signal lines to an electrode providing a voltage level equivalent to the voltage supplied to the common electrode.

21. A display device according to claim 20, wherein the image signal line drive circuit further comprises:

a plurality of reference voltage bus lines to which are given the plurality of reference voltages, respectively; and a voltage switching circuit, when the polarity of the voltage applied to the capacitive load is reversed, for applying to one reference voltage bus line of the plurality of reference voltage bus lines a voltage level equivalent to the common electrode signal, instead of the reference voltage to be applied to the one reference voltage bus line, and wherein each of the reference voltage selection circuits, during each horizontal scan period, selects a reference voltage bus line of the plurality of reference voltage bus lines to which is applied a reference voltage responsive to the image signal and connects the selected bus line to a corresponding image signal line and, when the polarity of the voltage applied to the capacitive load is reversed, selects and connects the one reference voltage bus line to the corresponding image signal line.

22. A display device according to claim 21, wherein the voltage level equivalent to the common electrode signal is the common electrode signal.

23. A display device in which a voltage serving as an image signal representing at least part of an image to be displayed is applied to a capacitive load including a capacitance formed by mutually opposing first and second electrodes, and which has a drive circuit that causes the voltage applied to the capacitive load to reverse polarity periodically, the display device comprising:

a common electrode drive circuit for supplying a voltage to the second electrode and switching the potential of the second electrode in response to the polarity reversal of the voltage applied to the capacitive load;

an image signal line drive circuit for supplying a voltage signal to the first electrode;

a connection switching circuit, when the polarity of the voltage applied to the capacitive load is reversed, for electrically separating the first electrode from the image signal line drive circuit and shorting the first electrode to an electrode providing a voltage level that is equivalent to the voltage supplied to the second electrode during a shorting interval; and wherein the common electrode drive circuit switches the potential of the second electrode within the shorting interval.

* * * * *